US011619427B2

(12) United States Patent
Shibata et al.

(10) Patent No.: US 11,619,427 B2
(45) Date of Patent: Apr. 4, 2023

(54) HEAT EXCHANGER AND HEAT PUMP SYSTEM HAVING SAME

(71) Applicant: DAIKIN INDUSTRIES, LTD., Osaka (JP)

(72) Inventors: Yutaka Shibata, Osaka (JP); Mitsuharu Numata, Osaka (JP); Tomoki Hirokawa, Osaka (JP); Hirokazu Fujino, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/885,168

(22) Filed: Aug. 10, 2022

(65) Prior Publication Data

US 2022/0381487 A1 Dec. 1, 2022

Related U.S. Application Data

(63) Continuation of application No. PCT/JP2021/004960, filed on Feb. 10, 2021.

(30) Foreign Application Priority Data

Feb. 10, 2020 (JP) ..... JP2020-021017

(51) Int. Cl.
*F28F 3/00* (2006.01)
*F25B 39/00* (2006.01)
(Continued)

(52) U.S. Cl.
CPC ..... *F25B 39/00* (2013.01); *F28D 9/00* (2013.01); *F28F 9/22* (2013.01); *F28F 2260/02* (2013.01)

(58) Field of Classification Search
CPC ..... F25B 39/00; F28D 9/00; F28F 9/22; F28F 2260/02
(Continued)

(56) References Cited

U.S. PATENT DOCUMENTS 6,619,066 B1 9/2003 Kaneo
6,688,137 B1 2/2004 Gupte
(Continued)

FOREIGN PATENT DOCUMENTS

CN 102287969 A 12/2011
JP H10-300384 A 11/1998
(Continued)

OTHER PUBLICATIONS

International Search Report issued in International Application No. PCT/JP2021/004960, dated Apr. 6, 2021 (3 pages).
(Continued)

*Primary Examiner* — Davis D Hwu
(74) *Attorney, Agent, or Firm* — Osha Bergman Watanabe & Burton LLP

(57) ABSTRACT

A heat exchanger includes: first layers each including first flow channels that are microchannels; and second layers each including second flow channels that are microchannels. The first layers and the second layers constitute a lamination. Heat is exchanged by performing either of: liquid evaporation in the first flow channels and gas condensation in the second flow channels, or liquid evaporation in the second flow channels and gas condensation in the first flow channels. The lamination includes: a first liquid transport pore that is in fluid communication with the first flow channels; and a second liquid transport pore that is in fluid communication with the second flow channels.

16 Claims, 15 Drawing Sheets

(51) Int. Cl.
*F28D 9/00* (2006.01)
*F28F 9/22* (2006.01)

(58) Field of Classification Search
USPC ..... 165/166
See application file for complete search history.

(56) References Cited

U.S. PATENT DOCUMENTS

| | | | | |
|---|---|---|---|---|
| 9,926,496 | B2 * | 3/2018 | Tonkovich | B01J 23/42 |
| 2004/0099712 | A1 * | 5/2004 | Tonkovich | B01J 19/0093 228/183 |
| 2005/0087767 | A1 * | 4/2005 | Fitzgerald | F15D 1/04 257/200 |
| 2009/0211977 | A1 * | 8/2009 | Miller | B01D 63/082 165/170 |
| 2015/0168081 | A1 | 6/2015 | Ito et al. | |

FOREIGN PATENT DOCUMENTS

| | | | |
|---|---|---|---|
| JP | 2004-275807 | A | 10/2004 |
| JP | 2007-333353 | A | 12/2007 |
| JP | 2019-20068 | A | 2/2019 |
| WO | 00/50822 | A1 | 8/2000 |
| WO | 2013/191056 | A1 | 12/2013 |

OTHER PUBLICATIONS

Notification of Reasons for Refusal issued in Japanese Patent Application No. 2020-21017, dated Mar. 8, 2022 (11 pages).
Trial and Appeal Decision along with Decision to Grant a Patent issued in Japanese Patent Application No. 2020-21017, mailed on Jun. 14, 2022 (3 pages).
International Preliminary Report on Patentability issued in corresponding International Patent Application No. PCT/JP2021/004960 dated Aug. 11, 2022 (7 pages).

* cited by examiner

HEAT EXCHANGER AND HEAT PUMP SYSTEM HAVING SAME

TECHNICAL FIELD

The present disclosure relates to a heat exchanger and a heat pump system having the same.

BACKGROUND

Heat exchangers having microchannels have been known. For example, Patent Document 1 discloses a heat exchanger using a supercritical fluid as a refrigerant and having refrigerant flow channels being not less than 10 μm but not more than 1000 μm both in height and width cross-sectionally.

PATENT LITERATURE

Patent Document 1: Japanese Unexamined Patent Publication No. 2007-333353

SUMMARY

One or more embodiments according to the present disclosure are directed to a heat exchanger (100) including: a plurality of first layers (10) each including a plurality of first flow channels (12) being microchannels; and a plurality of second layers (20) each including a plurality of second flow channels (22) being microchannels, the plurality of first layers (10) and the plurality of second layers (20) constituting a lamination (110), and heat exchange being carried out by performing liquid evaporation in either one of the plurality of first flow channels (12) of the first layers (10) or the second flow channels (22) of the second layers (20) and performing gas condensation in the other one of the plurality of first flow channels (12) of the first layers (10) or the second flow channels (22) of the second layers (20). The lamination (110) has a first liquid transport pore (111) and a second liquid transport pore (112), the first liquid transport pore (111) being in fluid communication with the plurality of first flow channels (12) of the plurality of first layers (10), and the second liquid transport pore (112) being in fluid communication with the plurality of second flow channels (22) of the plurality of second layers (20), and the heat exchanger (100) comprises a distribution member (40, 50) in one or each of the first and second liquid transport pores (111, 112), the distribution member (40, 50) being for uniformly distributing a fluid containing a liquid as an evaporation source to the plurality of first layers (10) and/or the plurality of second layers (20).

DETAILED DESCRIPTION

In the following, embodiments will be described in detail.

FIRST EMBODIMENTS

<Heat Exchanger (100)>

Figure 1:
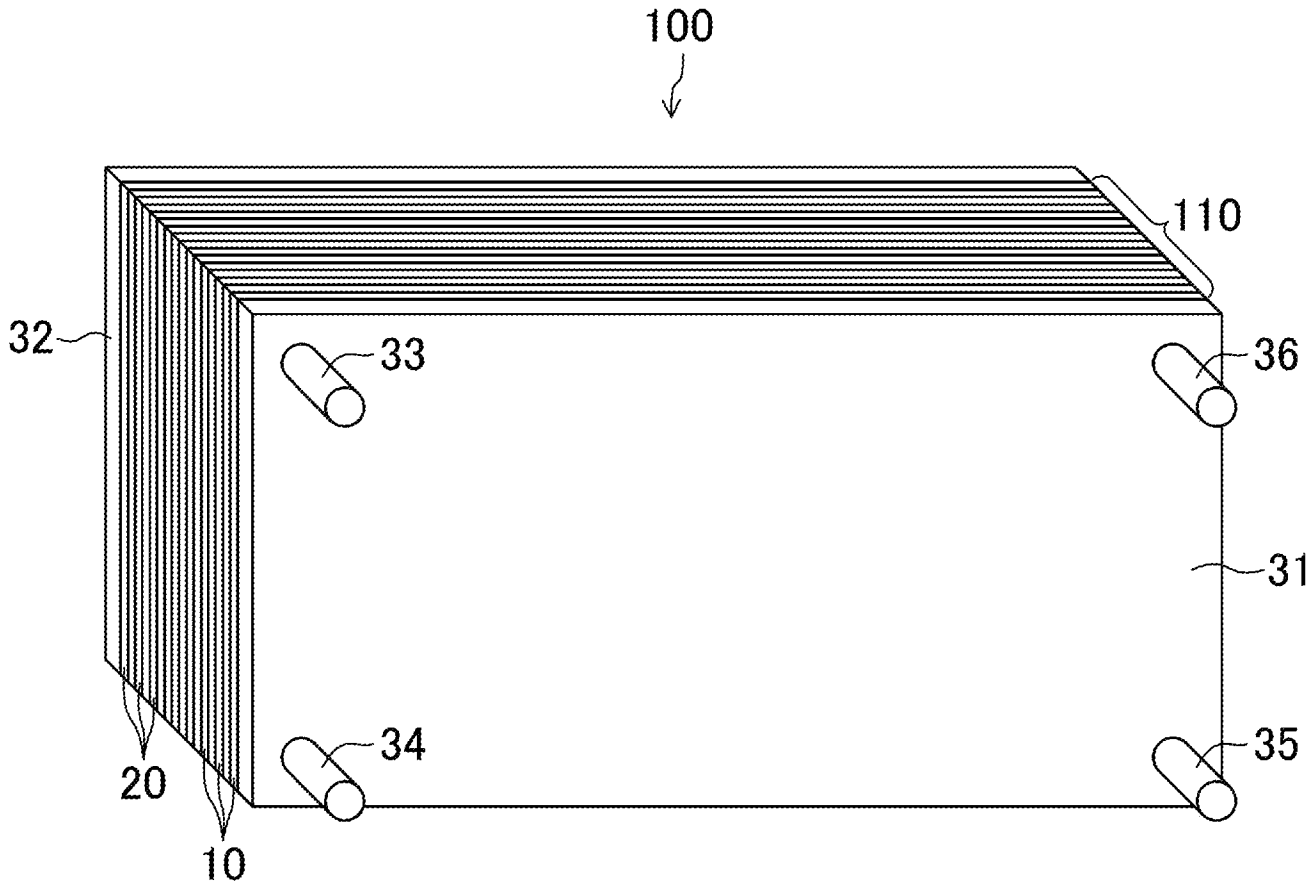
FIG. 1 is a perspective view of a heat exchanger (100) according to first embodiments.
Figure 2:
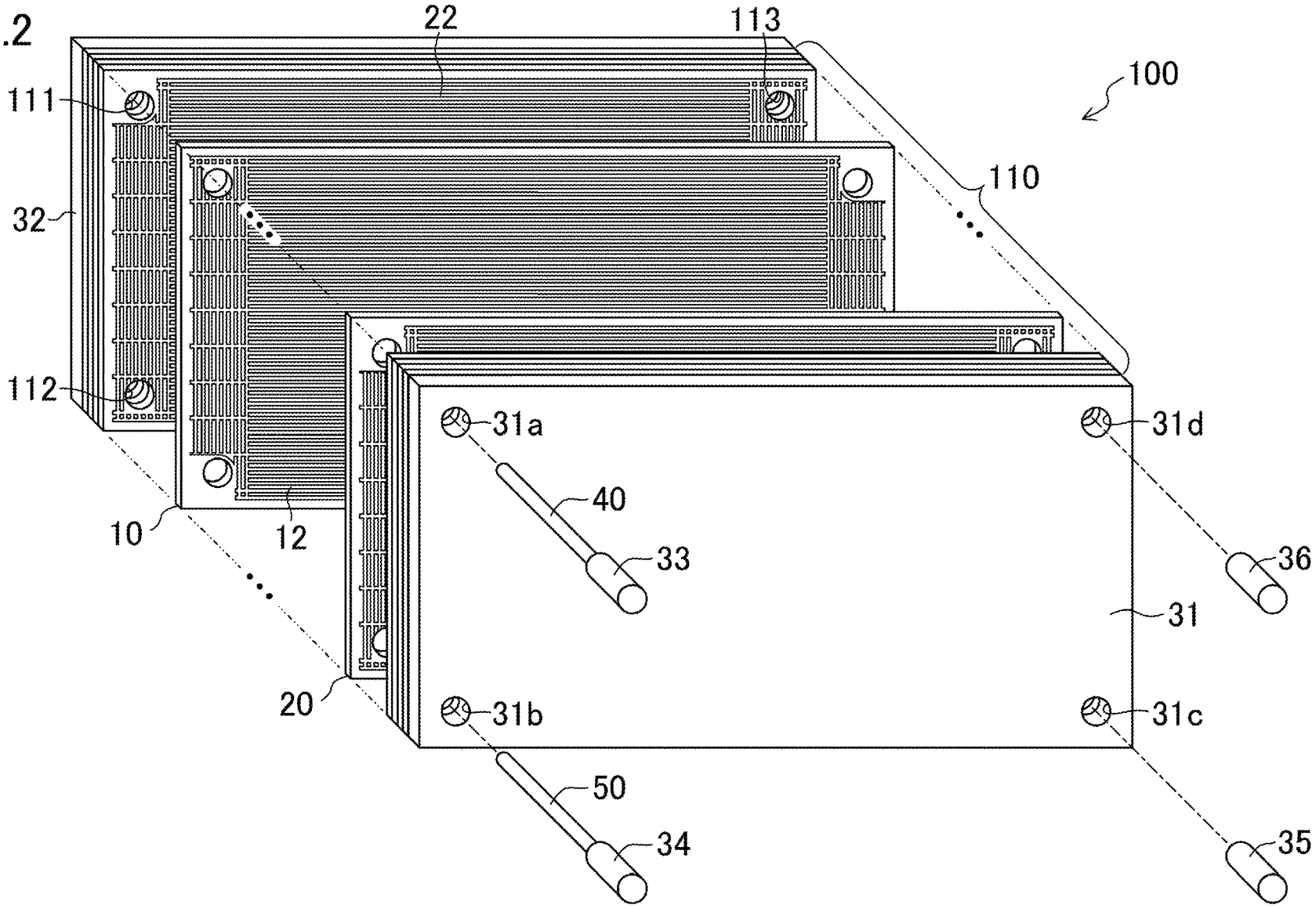
FIG. 2 is an exploded perspective view of the heat exchanger (100) according to the first embodiments.

FIGS. 1 and 2 illustrate a heat exchanger (100) according to first embodiments. The heat exchanger (100) according to the first embodiments may be applicable as a cascade condenser of a heat pump system (60), or the like, for example.

The heat exchanger (100) according to the first embodiments includes a plurality of first layers (10), a plurality of second layers (20), and a pair of end plates (31, 32). The first and second layers (10, 20) constitute an alternating lamination (110) in which the first and second layers (10, 20) are alternately laminated. The first and second layers (10, 20) are configured to let first and second fluids flow therethrough, respectively, so as to perform interlayer heat exchange by condensing a gas in one of the first and second layers (10, 20) and evaporating a liquid in the other one of the first and second layers (10, 20). The pair of end plates (31, 32) is provided in such a way to sandwich the alternating lamination (110) of the first and second layers (10, 20).

Figure 3:
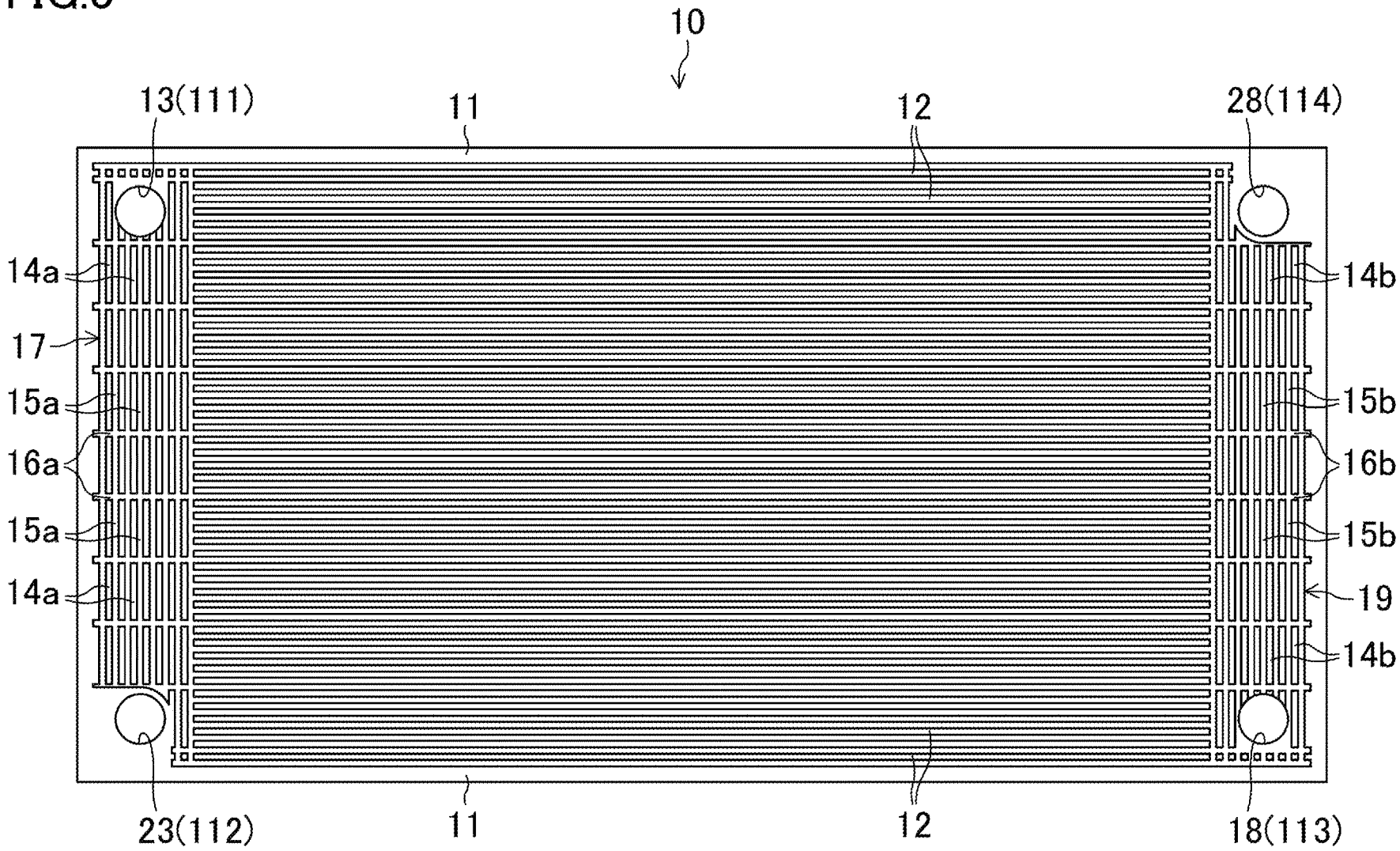
FIG. 3 is a plan view of a first layer (10).
Figure 4:
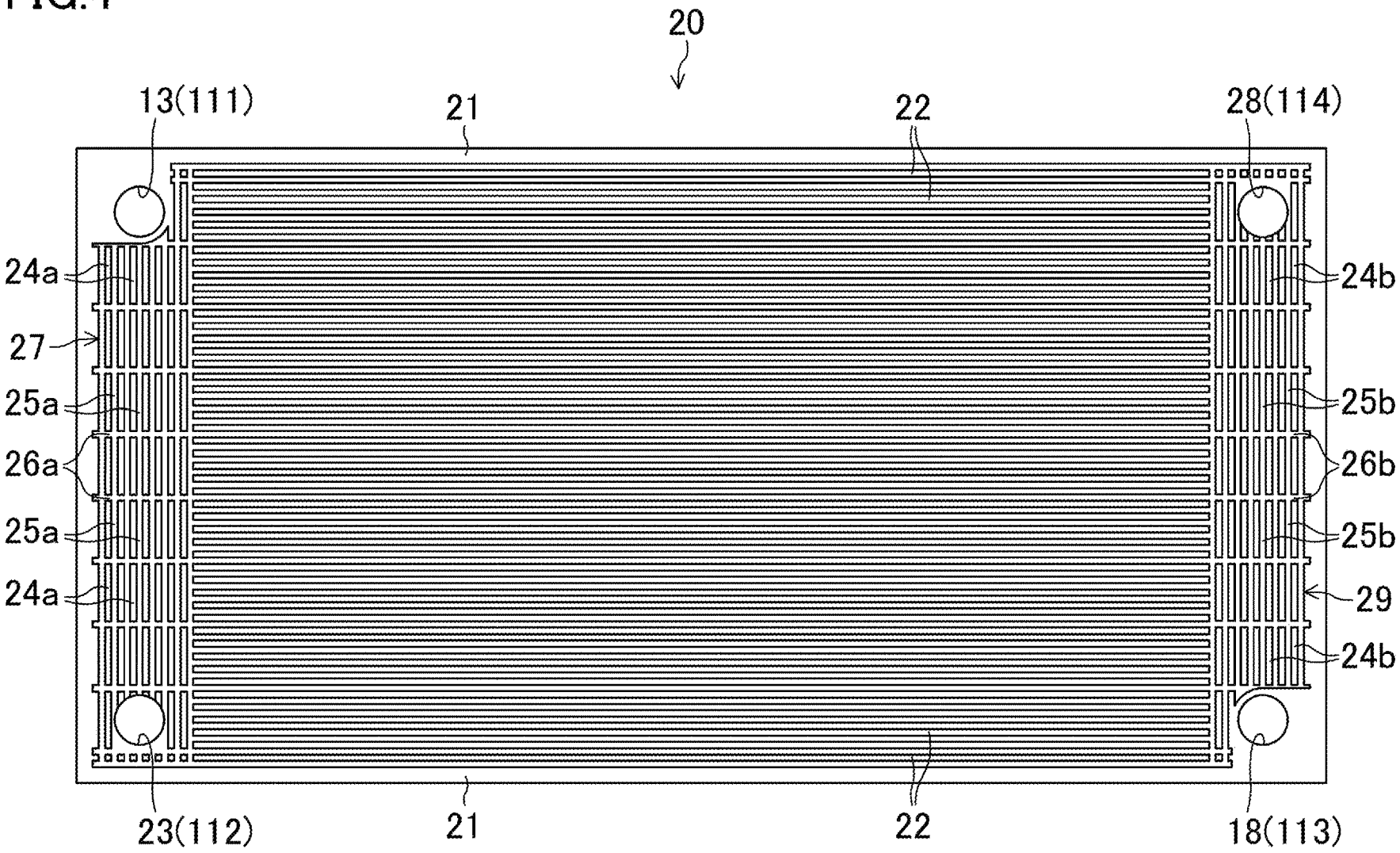
FIG. 4 is a plan view of a second layer (20).

FIG. 3 illustrates such a first layer (10). FIG. 4 illustrates such a second layer (20). It should be noted that expressions used in the following description for indicating directions such as "upper," "lower," "left," and "right" are just for the sake of convenience in explaining based on the drawings, but not for indicating how things are arranged or positioned actually in such directions.

Each of the first and second layers (10, 20) is made of a rectangular metal sheet member. The first and second layers (10, 20) are so configured that a number of grooves are provided within a peripheral portion (11, 21) on one side of the first or second layer (10, 20) by mechanical processing or etching, as described later. These grooves form pores when openings of the grooves are sealed by laminating the first layer (10), second layer (20), or end plate (31) on the first or second layer (10, 20). In the present application, both the grooves of the first and second layers (10, 20) still open and the pores formed by sealing the openings thereof are referred to as "microchannels" or "flow channels."

Figure 5:
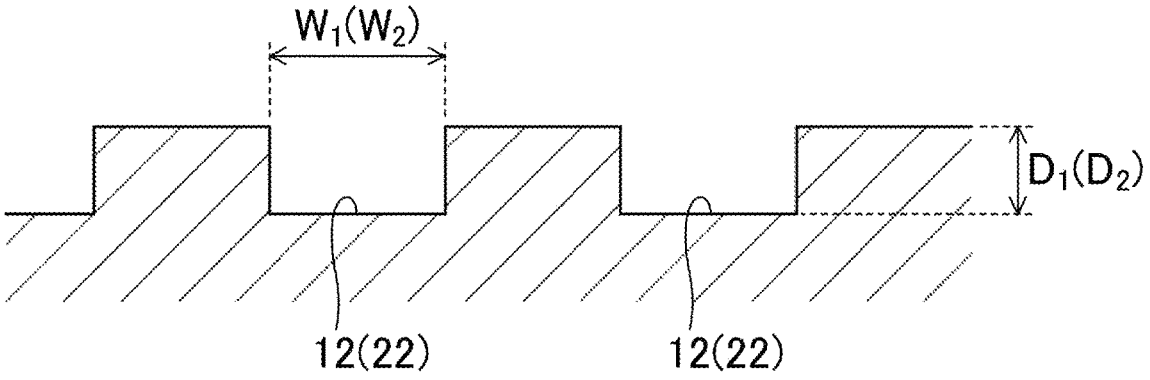
FIG. 5 is a cross-sectional view of first flow channels (12) (second flow channels (22)).

The first layer (10) has a plurality of grooves in a middle portion thereof in the right-left direction as shown in FIG. 3 in such way that the plurality of grooves are aligned side by side in the up-down direction of the drawing to straightly extend side by side in the right-left direction. The plurality of grooves constitute a plurality of first flow channels (12) of the first layer (10). Similarly, the second layer (20) has a plurality of grooves in a middle portion thereof in the right-left direction as shown in FIG. 4 in such way that the plurality of grooves are aligned side by side in the up-down direction of the drawing to extend straightly side by side in the right-left direction. The plurality of grooves constitute a plurality of second flow channels (22) of the second layer (20). As illustrated in FIG. 5, the grooves constituting the first and second flow channels (12, 22) have a rectangular cross section. Moreover, the grooves constituting the first and second flow channels (12, 22) are not less than 10 μm but not more than 1000 μm both in dimensions ($D_1$, $D_2$) in the lamination direction of the first and second layers (10, 20) and in width dimensions ($W_1$, $W_2$) in a direction perpendicular to the lamination direction. Thus, both the first and second flow channels (12, 22) are microchannels. The dimensional configurations of the first and second flow channels (12, 22) may be identical with each other or different from each other.

The first and second flow channels (12, 22) may be provided to extend meanderingly or zigzag. The first and second flow channels (12, 22) may be formed with a semicircular cross section or another cross section.

The first layer (10) has a first liquid transport section (13) and a second liquid transport section (23), which are round pores and located respectively at an upper left corner portion and at a lower left corner portion of the first layer (10) on one-end side (left side) with respect to the plurality of first flow channels (12) in the right-left direction, and the first liquid transport section (13) and the second liquid transport section (23) penetrate the first layer (10) in the thickness direction. In the region of the first layer (10) where the first liquid transport section (13) is provided on the left side of the plurality of first flow channels (12), short ridges (14*a*) being rectangular in cross section and extending in the up-down direction of the drawing are provided in tandem in the up-down direction of the drawing with gaps therebetween and aligned side by side in the right-left direction with gaps therebetween.

Figure 6:
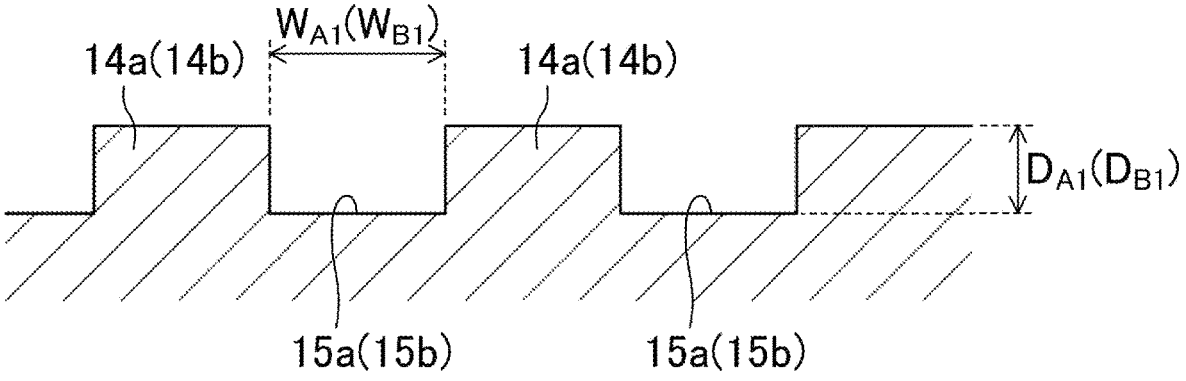
FIG. 6 is a cross-sectional view of first microchannels A (15*a*) (first microchannels B (15*b*)).

Between ridges (14*a*) neighboring in the right-left direction, a groove is formed, which has a rectangular cross section and extends straightly in the up-down direction of the drawing perpendicular to the right-left direction in which the plurality of first flow channels (12) extend, as illustrated in FIG. 6. This groove constitutes a first microchannel A (15*a*). These first microchannels A (15*a*) are in fluid communication with each other not only in the up-down direction of the drawing, but also in the right-left direction through the gaps formed between neighboring ridges (14*a*) neighbored in the up-down direction of the drawing. The gaps between the ridges (14*a*) constitute first bypass flow channels A (16*a*).

With this configuration, the first layer (10) includes a first one end-side collective flow channel (17) on the left side with respect to the plurality of first flow channels (12), the first one end-side collective flow channel (17) including the first microchannels A (15*a*) and the first bypass flow channels A (16*a*) and being in fluid communication with each one end of the first flow channels (12). Because the first liquid transport section (13) is provided in the region where the first one end-side collective flow channel (17) is provided, the first one end-side collective flow channel (17) will maintain the fluid communication with the first liquid transport section (13) even after the opening of the first one end-side collective flow channel (17) is sealed with the second layer (20) or the end plate (31). Thus, the first one end-side collective flow channel (17) constitutes a liquid flow channel. What is meant by the term "liquid flow channel" in this application is a channel for letting a liquid flow therethrough, where the liquid may be a liquid produced by condensation of a gas, a liquid before evaporation to a gas, or a gas-liquid mixture fluid mainly containing such a liquid by weight. On the other hand, because the second liquid transport section (23) is provided outside the region in which the first one end-side collective flow channel (17) is provided, the first one end-side collective flow channel (17) will be blocked from the second liquid transport section (23) when the opening of the first one end-side collective flow channel (17) is sealed with the second layer (20) or the end plate (31).

The first layer (10) has a first gas transport section (18) and a second gas transport section (28), which are round pores and located respectively at a right lower corner portion and a right upper corner portion of the first layer (10) on the other-end side (right side) with respect to the plurality of first flow channels (12) in the right-left direction, and the first gas transport section (18) and the second gas transport section (28) penetrate the first layer (10) in the thickness direction. In the region of the first layer (10) where the first gas transport section (18) is provided on the right side of the plurality of first flow channels (12), short ridges (14*b*) being rectangular in cross section and extending in the up-down direction of the drawing are provided in tandem in the up-down direction of the drawing with gaps therebetween and aligned side by side in the right-left direction with gaps therebetween.

Figure 7:
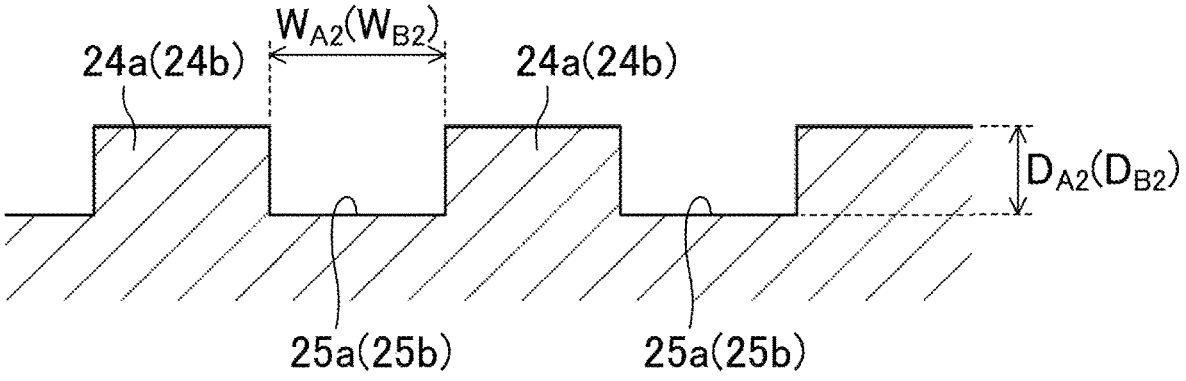
FIG. 7 is a cross-sectional view of second microchannels A (25*a*) (second microchannels B (25*b*)).

Between ridges (14*b*) neighboring in the right-left direction, a groove is formed, which has a rectangular cross section and extends straightly in the up-down direction of the drawing perpendicular to the right-left direction in which the plurality of first flow channels (12) extend, as illustrated in FIG. 7. This groove constitutes a first microchannel B (15*b*). These first microchannels B (15*b*) are in fluid communication with each other not only in the up-down direction of the drawing, but also in the right-left direction through the gaps formed between neighboring ridges (14*b*)

neighbored in the up-down direction of the drawing. The gaps between the ridges (14*b*) constitute first bypass flow channels B (16*b*).

With this configuration, the first layer (10) includes a first other end-side collective flow channel (19) on the right side with respect to the plurality of first flow channels (12), the first other end-side collective flow channel (19) including the first microchannels B (15*b*) and the first bypass flow channels B (16*b*) and being in fluid communication with the other ends of the first flow channels (12). Because the first gas transport section (18) is provided in the region where the first other end-side collective flow channel (19) is provided, the first other end-side collective flow channel (19) will maintain the fluid communication with the first gas transport section (18) even after the opening of the first other end-side collective flow channel (19) is sealed with the second layer (20) or the end plate (31). Thus, the first other end-side collective flow channel (19) constitutes a gas flow channel. Here, what is meant by the term "gas flow channel" in this application is a flow channel for letting a gas flow therethrough, where the gas may be a gas before condensation to a liquid, a gas produced by evaporation of a liquid, or a gas-liquid mixture fluid mainly containing such a gas by weight. On the other hand, because the second gas transport section (28) is provided outside the region in which the first other end-side collective flow channel (19) is formed, the first other end-side collective flow channel (19) will be blocked from the second gas transport section (28) when the opening of the first other end-side collective flow channel (19) is sealed with the second layer (20) or the end plate (31).

The second layer (20) includes the first liquid transport section (13) and the second liquid transport section (23), which are round pores and located respectively at an upper left corner portion and at a lower left corner portion of the second layer (20) on one-end side (left side) of the plurality of second flow channels (22) in the right-left direction, and the first liquid transport section (13) and the second liquid transport section (23) penetrate the second layer (20) in the thickness direction. In the region of the second layer (20) where the second liquid transport section (23) is provided on the left side of the plurality of second flow channels (22), short ridges (24*a*) being rectangular in cross section and extending in the up-down direction of the drawing are provided in tandem in the up-down direction of the drawing with gaps therebetween and aligned side by side in the right-left direction with gaps therebetween.

Between ridges (24*a*) neighboring in the right-left direction, a groove is formed, which has a rectangular cross section and extends straightly in the up-down direction of the drawing perpendicular to the right-left direction in which the plurality of second flow channels (22) extend, as illustrated in FIG. 6. This groove constitutes a second microchannel A (25*a*). These second microchannels A (25*a*) are in fluid communication with each other not only in the up-down direction of the drawing, but also in the right-left direction through the gaps formed between neighboring ridges (24*a*) neighbored in the up-down direction of the drawing. The gaps between the ridges (24*a*) constitute second bypass flow channels A (26*a*).

With this configuration, the second layer (20) includes a second one end-side collective flow channel (27) on the left side with respect to the plurality of second flow channels (22), the second one end-side collective flow channel (27) including the second microchannels A (25*a*) and the second bypass flow channels A (26*a*) and being in fluid communication with the one ends of the second flow channels (22). Because the second liquid transport section (23) is provided in the region where the second one end-side collective flow channel (27) is provided, the second one end-side collective flow channel (27) will maintain the fluid communication with the second liquid transport section (23) even after the opening of the second one end-side collective flow channel (27) is sealed with the first layer (10). Thus, the second one end-side collective flow channel (27) constitutes a liquid flow channel. On the other hand, because the first liquid transport section (13) is provided outside the region in which the second one end-side collective flow channel (27) is provided, the second one end-side collective flow channel (27) will be blocked from the first liquid transport section (13) when the opening of the second one end-side collective flow channel (27) is sealed with the first layer (10).

The second layer (20) includes the first gas transport section (18) and the second gas transport section (28), which are round pores and located respectively at the right lower corner portion and the right upper corner portion of the second layer (20) on the other-end side (right side) with respect to the plurality of second flow channels (22) in the right-left direction, and the first gas transport section (18) and the second gas transport section (28) penetrate the second layer (20) in the thickness direction. In the region of the second layer (20) where the second gas transport section (28) is provided on the right side of the plurality of second flow channels (22), short ridges (24*b*) being rectangular in cross section and extending in the up-down direction of the drawing are provided in tandem in the up-down direction of the drawing with gaps therebetween and aligned side by side in the right-left direction with gaps therebetween.

Between ridges (24*b*) neighboring in the right-left direction, a groove is formed, which has a rectangular cross section and extends straightly in the up-down direction of the drawing perpendicular to the right-left direction in which the plurality of second flow channels (22) extend, as illustrated in FIG. 7. This groove constitutes a second microchannel B (25*b*). These second microchannels B (25*b*) are in fluid communication with each other not only in the up-down direction of the drawing, but also in the right-left direction through the gaps formed between neighboring ridges (24*b*) neighbored in the up-down direction of the drawing. The gaps between the ridges (24*b*) constitute second bypass flow channels B (26*b*).

With this configuration, the second layer (20) includes a second other end-side collective flow channel (29) on the right side with respect to the plurality of second flow channels (22), the second other end-side collective flow channel (29) including the second microchannels B (25*b*) and the second bypass flow channels B (26*b*) and being in fluid communication with the other ends of the second flow channels (22). Because the second gas transport section (28) is provided in the region where the second other end-side collective flow channel (29) is provided, the second other end-side collective flow channel (29) will maintain the fluid communication with the second gas transport section (28) even after the opening of the second other end-side collective flow channel (29) is sealed with the first layer (10). Thus, the second other end-side collective flow channel (29) constitutes a gas flow channel. On the other hand, because the first gas transport section (18) is provided outside the region in which the second other end-side collective flow channel (29) is provided, the second other end-side collective flow channel (29) will be blocked from the first gas transport section (18) when the opening of the second other end-side collective flow channel (29) is sealed with the first layer (10).

The first microchannels A (15*a*) of the first one end-side collective flow channel (17) and the first microchannels B (15*b*) of the first other end-side collective flow channel (19) of the first layer (10) are not less than 10 μm but not more than 1000 μm both in dimensions ($D_{A1}$, $D_{B1}$) in the lamination direction of the first and second layers (10, 20) and in width dimensions ($W_{A1}$, $W_{B1}$) in a direction perpendicular to the lamination direction. The dimensional configurations of the first microchannels A and B (15*a*, 15*b*) may be identical with the first flow channels (12) or different from the first flow channels (12). However, for securing a flow amount of a first fluid flowing through the first microchannels A and B (15*a*, 15*b*) while avoiding an excessive increase in a rate of the first fluid, the first microchannels A and B (15*a*, 15*b*) may be configured such that the dimensions ($D_{A1}$, $D_{B1}$) in the lamination direction of the first and second layers (10, 20) are equal to that of the first flow channels (12) and the width dimensions ($W_{A1}$, $W_{B1}$) in the direction perpendicular to the lamination direction are equal to or greater than that of the first flow channels (12), or more specifically a dimensional ratio of the width dimensions ($W_{A1}$, $W_{B1}$) of the first microchannels A and B (15*a*, 15*b*) with respect to that of the first flow channels (12) may be one time or more but three times or less. Moreover, the first bypass flow channels A and B (16*a*, 16*b*) may be microchannels.

The second microchannels A (25*a*) of the second one end-side collective flow channel (27) and the second microchannels B (25*b*) of the second other end-side collective flow channel (29) of the second layer (20) are not less than 10 μm but not more than 1000 μm in dimensions ($D_{A2}$, $D_{B2}$) in the lamination direction of the first and second layers (10, 20) and in width dimensions ($W_{A2}$, $W_{B2}$) in the direction perpendicular to the lamination direction. The dimensional configurations of the second microchannels A and B (25*a*, 25*b*) may be identical with the second flow channels (22) or different from the second flow channels (22). However, for securing a flow amount of a second fluid flowing through the second microchannels A and B (25*a*, 25*b*) while avoiding an excessive increase in a rate of the second fluid, the second microchannels A and B (25*a*, 25*b*) may be configured such that the dimensions ($D_{A2}$, $D_{B2}$) in the lamination direction of the first and second layers (10, 20) are equal to that of the second flow channel (22) and the width dimensions ($W_{A2}$, $W_{B2}$) in the direction perpendicular to the lamination direction are equal to or greater than that of the second flow channel (22), more specifically a dimensional ratio of the width dimensions ($W_{A2}$, $W_{B2}$) of the second microchannels A and B (25*a*, 25*b*) with respect to that of the second flow channel (22) may be one time or more but three times or less. Moreover, the second bypass flow channels A and B (26*a*, 26*b*) may be microchannels.

The first layer (10) may be produced in such a way that both the first flow channels (12) and the first microchannels A and B (15*a*, 15*b*) are fabricated at the same time because the first flow channels (12) and the first microchannels A and B (15*a*, 15*b*) are all microchannels. Similarly, the second layer (20) may be produced in such a way that both the second flow channels (22) and the second microchannels A and B (25*a*, 25*b*) are fabricated at the same time because the second flow channels (22) and the second microchannels A and B (25*a*, 25*b*) are all microchannels.

In an alternating lamination (110) in which the first and second layers (10, 20) are alternately laminated, the first liquid transport sections (13), the second liquid transport sections (23), the first gas transport sections (18), and the second gas transport sections (28) of the first and second layers (10, 20) thus laminated are sequentially joined with each other to respectively form the first liquid transport pore (111), the second liquid transport pore (112), s first gas transport pore (113), and a second gas transport pore (114), which are cylindrically tubular in geometry.

The first liquid transport pore (111) and the first gas transport pore (113) are in fluid communication with the flow channels in the first layer (10) but not with the flow channels in the second layer (20). Therefore, after supplied to one of the first liquid transport pore (111) or the first gas transport pore (113), the first fluid is distributed to the first layers (10) but not to the second layers (20), so that the first fluid flows through the first flow channels (12), the first one end-side collective flow channel (17), and the first other end-side collective flow channel (19) inside the first layers (10), and merges at the other side and flows out collectively from the first layers (10).

Moreover, on the contrary, the second liquid transport pore (112) and the second gas transport pore (114) are not in fluid communication with the flow channels in the first layer (10) while the second liquid transport pore (112) and the second gas transport pore (114) are in fluid communication with the flow channels in the second layer (20). Therefore, after supplied to one of the second liquid transport pore (112) or the second gas transport pore (114), the second fluid is distributed to the second layers (20), flows through the second flow channels (22), the second one end-side collective flow channel (27), and the second other end-side collective flow channel (29) in the second layers (20), and merges at the other side and flows out collectively from the second layers (20).

The alternating lamination (110) of the first and second layers (10, 20) is so configured that the first and second layers (10, 20) are laminated with each other in such a way that the first and second flow channels (12, 22) extend parallel to each other, as illustrated in FIG. 2. In this case, the first fluid in the first flow channels (12) of the first layer (10) and the second fluid in the second flow channels (22) of the second layer (20) flow in opposite directions in plan view.

The pair of end plates (31, 32) is made of a rectangular metal plate member, which has a shape identical with those of the first and second layers (10, 20). The end plate (31), which is one of the pair, is laminated on one side of the alternating lamination (110) of the first and second layers (10, 20). The end plate (31) has four pores (31*a*, 31*b*, 31*c*, 31*d*), which correspond to the first liquid transport pore (111), the second liquid transport pore (112), the first gas transport pore (113), and the second gas transport pore (114), respectively. The four pores (31*a*, 31*b*, 31*c*, 31*d*) are connected with a first liquid inlet/outlet pipe (33), a second liquid inlet/outlet pipe (34), a first gas inlet/outlet pipe (35), and a second gas inlet/outlet pipe (36), respectively. The end plate (32), which is the other one of the pair, is laminated on the other side of the alternating lamination (110) of the first and second layers (10, 20) to seal the first liquid transport pore (111), the second liquid transport pore (112), the first gas transport pore (113), and the second gas transport pore (114).

Figure 8:
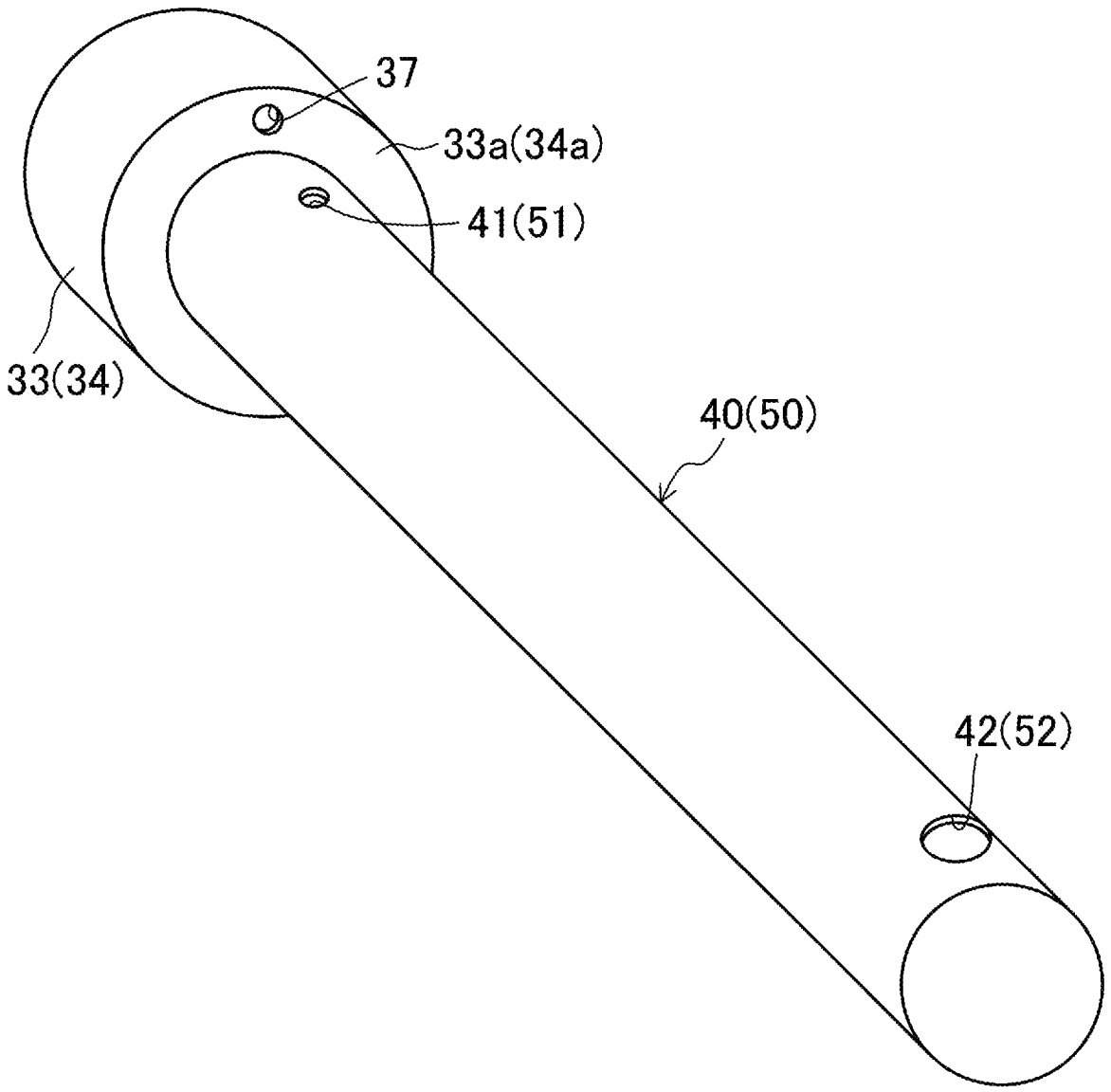
FIG. 8 is a perspective view of a first distribution member (40) (second distribution member (50)) according to the first embodiments.
Figure 9:
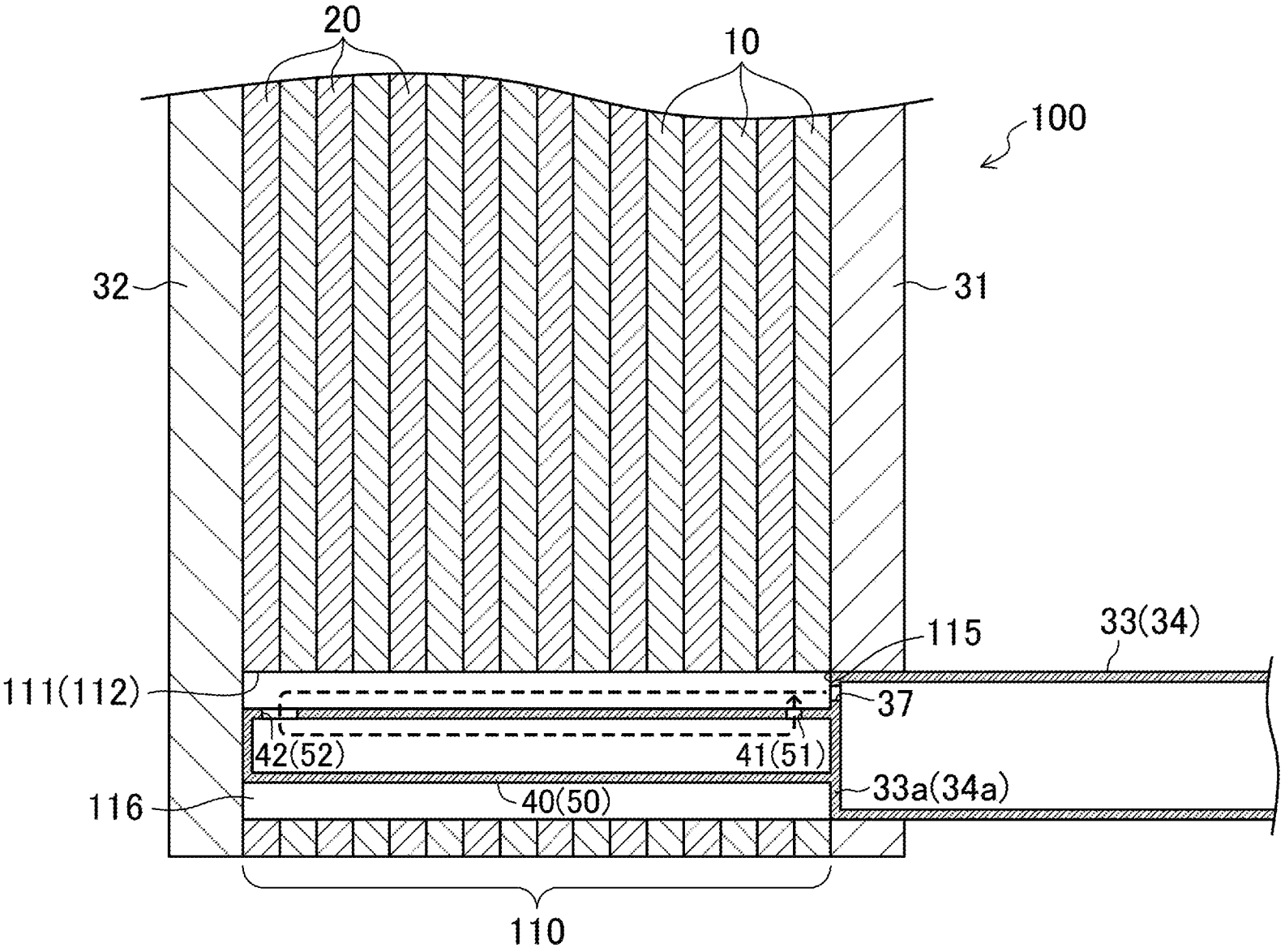
FIG. 9 is a cross-sectional view of a structure of a heat exchanger (100) according to the first embodiments, in which the first distribution member (40) (second distribution member (50)) is provided in a first liquid transport pore (111) (second liquid transport pore (112)).

The heat exchanger (100) according to the first embodiments is so configured that, as illustrated in FIGS. 8 and 9, the first liquid inlet/outlet pipe (33) is sealed at a distal end and is integrated with a first distribution member (40), which is provided coaxially to a distal end surface (33*a*) of the first liquid inlet/outlet pipe (33) and has a cylindrical shape with a smaller diameter than the first liquid inlet/outlet pipe (33). The first distribution member (40) is also sealed at its distal end, so that the first distribution member (40) is a tubular member sealed at both ends. The first distribution member (40) is provided coaxially to the first liquid transport pore (111) along a longitudinal direction of the first liquid transport pore (111) in such a way that there is a gap (116) fully circumferentially around the first distribution member (40) and the distal end of the first distribution member (40) abuts against the end plate (32), which is the other one of the pair.

The distal end surface (33*a*) of the first liquid inlet/outlet pipe (33) has a small pore (37) for fluid communication between the inside of the pipe and outside of the first distribution member (40). In a case of supplying the first fluid containing the liquid as the evaporation source from the first liquid inlet/outlet pipe (33), the first fluid flows in via the small pore (37) from one end of the first liquid transport pore (111). Therefore, the one end of the first liquid transport pore (111) constitutes a fluid inlet section (115) for the first fluid. The first distribution member (40) has a returning pore (41) and a redirecting pore (42) on its outer peripheral surface, the returning pore (41) and the redirecting pore (42) being provided respectively to a proximal end and a distal end of the first distribution member (40) with respect to the fluid inlet section (115) in the longitudinal direction of the first distribution member (40), the returning pore (41) and the redirecting pore (42) providing fluid communication with an inside of the first distribution member (40). The returning pore (41) is smaller in opening area than the redirecting pore (42).

Similarly, as illustrated in FIGS. 8 and 9, the second liquid inlet/outlet pipe (34) is sealed at a distal end and is integrated with a second distribution member (50), which is provided coaxially to a distal end surface (34*a*) of the second liquid inlet/outlet pipe (34) and has a cylindrical shape with a smaller diameter than the second liquid inlet/outlet pipe (34). The second distribution member (50) is also sealed at its distal end, so that the second distribution member (50) is a tubular member sealed at both ends. The second distribution member (50) is provided coaxially to the second liquid transport pore (112) along a longitudinal direction of the second liquid transport pore (112) in such a way that there is a gap (116) fully circumferentially around the second distribution member (50) and the distal end of the second distribution member (50) abuts against the end plate (32), which is the other one of the pair.

The distal end surface (34*a*) of the second liquid inlet/outlet pipe (34) has a small pore (37) for fluid communication between the inside of the pipe and outside of the second distribution member (50). In a case of supplying the second fluid containing the liquid as the evaporation source from the second liquid inlet/outlet pipe (34), the second fluid flows in via the small pore (37) from one end of the second liquid transport pore (112). Therefore, the one end of the second liquid transport pore (112) constitutes a fluid inlet section (115) for the second fluid. The second distribution member (50) has a returning pore (51) and a redirecting pore (52) on its outer peripheral surface, the returning pore (51) and the redirecting pore (52) being provided respectively to a proximal end and a distal end of the second distribution member (50) with respect to the fluid inlet section (115) in the longitudinal direction of the second distribution member (50), the returning pore (51) and the redirecting pore (52) providing fluid communication with an inside of the second distribution member (50). The returning pore (51) is smaller in opening area than the redirecting pore (52).

Each of the first and second fluids for flowing in the first and second layers (10, 20) may be a CFC refrigerant or a natural refrigerant, independently. Examples of the CFC refrigerant include R410A, R32, R134a, HFO, and the like. Examples of the natural refrigerant include $CO_2$, hydrocarbon such as propane, and the like.

Figure 10:
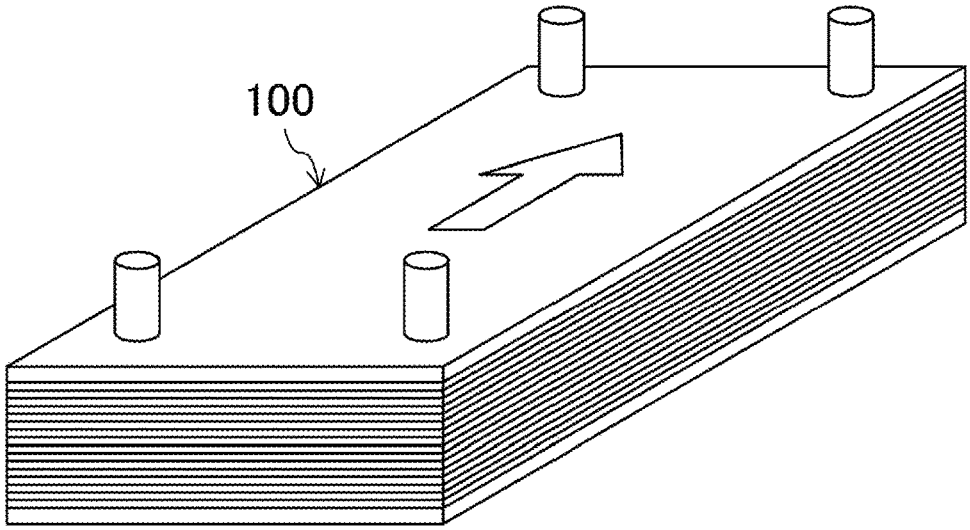
FIG. 10 is a perspective view illustrating a first installation posture of the heat exchanger (100) according to the first embodiments.
Figure 11:
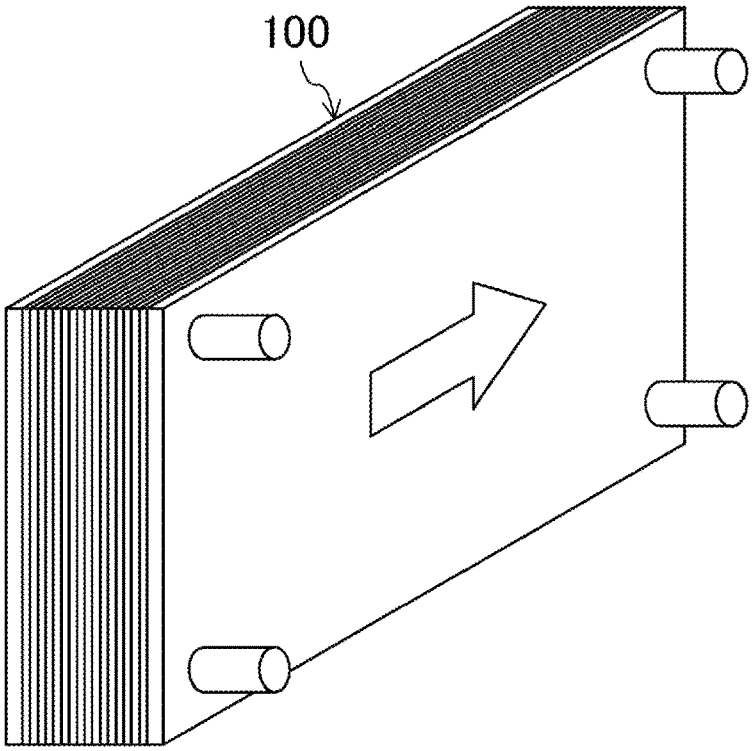
FIG. 11 is a perspective view illustrating a second installation posture of the heat exchanger (100) according to the first embodiments.

In the heat exchanger (100) according to the first embodiments configured as above, the first and second layers (10, 20) constituting the alternating lamination (110) include the first and second flow channels (12, 22), respectively, which are microchannels. As a result, the heat exchanger (100) can be installed without considering the orientation of the flow direction of the fluid, that is, freely from the restrictions as to the orientation of the flow direction of the fluid, so that a large degree of freedom in installation can be obtained. Therefore, the heat exchanger (100) according to the first embodiments with such a large degree of freedom in installation can be installed, for example as illustrated in FIGS. 10 and 11, in such a way that the plurality of first flow channels (12) of each of the first layers (10) and the plurality of second flow channels (22) of each of the second layers (20) will extend in the horizontal direction. Therefore, the heat exchanger (100) according to the first embodiments is installed in such a way that the first and second fluids are caused to flow in the horizontal direction (the direction indicated by the arrows in FIGS. 10 and 11). The plate-type heat exchangers are generally installed in such a posture that the refrigerant flow channels are oriented vertically, otherwise such plate-type heat exchangers would cause a significant performance deterioration. However, the heat exchanger (100) according to the first embodiments can be installed in such a posture that the fluids flow in the horizontal direction as described above which is said to deteriorate the performance of plate-type heat exchangers.

Moreover, in the heat exchanger (100) according to the first embodiments, the heat exchange is carried out by evaporating a liquid in either one of the plurality of first flow channels (12) of the first layers (10) or the second flow channels (22) of the second layers (20) and condensing a gas in the other one of the plurality of first flow channels (12) of the first layers (10) or the second flow channels (22) of the second layers (20).

In a case of evaporating a liquid in the first flow channels (12) in the first layers (10), a first fluid containing the liquid as the evaporation source is distributed to the plurality of first layers (10) via the first liquid transport pore (111). More specifically, the first fluid flows into the gap (116) between the first distribution member (40) and the first liquid transport pore (111) via the small pore (37) from the first liquid inlet/outlet pipe (33), through the fluid inlet section (115) at one end of the first liquid transport pore (111). This gap (116) is in fluid communication with the plurality of first flow channels (12) of the plurality of first layers (10). When flowing as above, the first fluid flows in such a way that, as indicated by the broken line in FIG. 9, part of the first fluid flows in one way along the first distribution member (40) and, thereafter, flows into the first distribution member (40) via the redirecting pore (42) and flows in the other way through the inside of the first distribution member (40) and flows out of the first distribution member (40) via the returning pore (41) so as to merge to the flow flowing in the one way.

Here, because the returning pore (41) is smaller in opening area than the redirecting pore (42), a greater amount of the first fluid flows into the first distribution member (40) via the redirecting pore (42) than via the returning pore (41), thereby creating such a pressure distribution in which pressure is relatively lower toward the returning pore (41) and is relatively higher toward the redirecting pore (42). This easily causes the first fluid to flow into the first distribution member (40) via the redirecting pore (42) and flow out from the first distribution member (40) via the returning pore (41).

With the configuration as above, the first fluid within the gap (116) becomes uniform in the longitudinal direction of the gap (116) by this flow, so that the first fluid can be distributed uniformly to the plurality of first layers (10).

Similarly, in a case of evaporating a liquid in the second flow channels (22) in the second layers (20), a second fluid containing the liquid as the evaporation source is distributed to the plurality of second layers (20) via the second liquid transport pore (112). More specifically, the second fluid flows into the gap (116) between the second distribution member (50) and the second liquid transport pore (112) via the small pore (37) from the second liquid inlet/outlet pipe (34), through the fluid inlet section (115) at one end of the second liquid transport pore (112). This gap (116) is in fluid communication with the plurality of second flow channels (22) of the plurality of second layers (20). When flowing as above, the second fluid flows in such a way that, as indicated by the broken line in FIG. 9, part of the second fluid flows in one way along the second distribution member (50) and, thereafter, flows into the second distribution member (50) via the redirecting pore (52) and flows in the other way through the inside of the second distribution member (50) and flows out of the second distribution member (50) via the returning pore (51) so as to merge to the flow flowing in the one way.

Here, because the returning pore (51) is smaller in opening area than the redirecting pore (52), a greater amount of the second fluid flows into the second distribution member (50) via the redirecting pore (52) than via the returning pore (51), thereby creating such a pressure distribution in which pressure is relatively lower toward the returning pore (51) and is relatively higher toward the redirecting pore (52). This easily causes the second fluid to flow into the second distribution member (50) via the redirecting pore (52) and flow out of the second distribution member (50) via the returning pore (51).

With the configuration as above, the second fluid within the gap (116) becomes uniform in the longitudinal direction of the gap (116) by this flow, so that the second fluid can be distributed uniformly to the plurality of second layers (20).

In addition, the heat exchanger (100) according to the first embodiments is configured such that, in the first layer (10), the first one end-side collective flow channel (17) and the first other end-side collective flow channel (19) include first microchannels A and B (15*a*, 15*b*), respectively, the first one end-side collective flow channel (17) and the first other end-side collective flow channel (19) being microchannels and provided on the one-end side and the other-end side with respect to the first flow channels (12), respectively. Moreover, in the second layer (20), the second one end-side collective flow channel (27) and the second other end-side collective flow channel (29) include second microchannels A and B (25*a*, 25*b*), respectively, the second one end-side collective flow channel (27) and the second other end-side collective flow channel (29) being microchannels and provided on the one-end side and the other-end side with respect to the second flow channels (22), respectively. This makes it possible to facilitate elimination of the need of a large space for the first one end-side collective flow channel (17) and the first other end-side collective flow channel (19) in the first layer (10), and to facilitate elimination of the need of a large space for the second one end-side collective flow channel (27) and the second other end-side collective flow channel (29) in the second layer (20). This also makes it possible to facilitate the reduction of the thickness necessary for withstanding pressures of the first and second fluids flowing through the first one end-side collective flow channel (17) and the first other end-side collective flow channel (19), and of the fluid flowing through the second one end-side collective flow channel (27) and the second other end-side collective flow channel (29), thereby making it unnecessary to form the end plates (31, 32) with a greater thickness. Therefore, this makes it possible to achieve the efficacies of the space saving and weight reduction of the heat exchanger (100) including such microchannels.

<Heat Pump System (60)>

Figure 12:
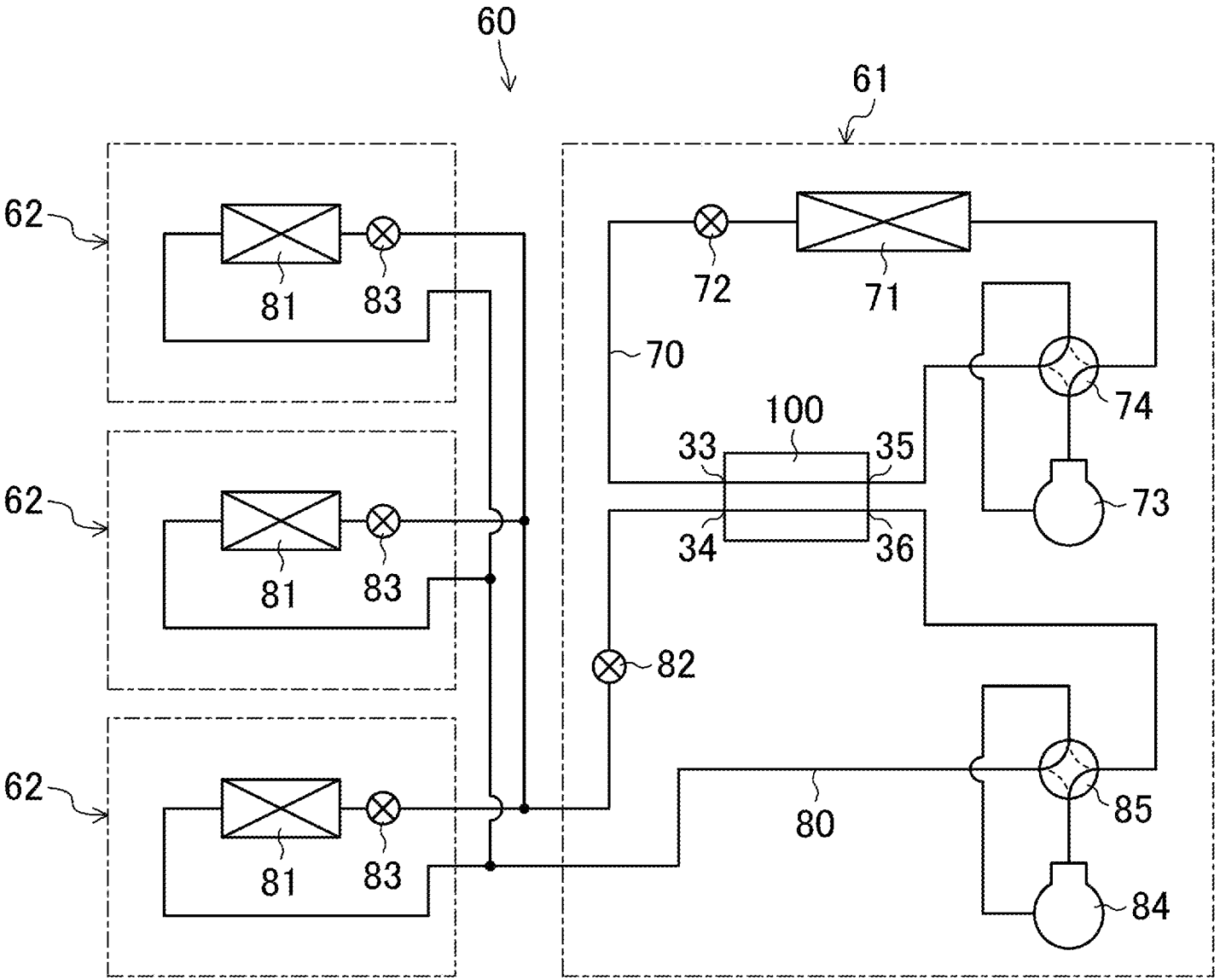
FIG. 12 is a schematic diagram of one example of a heat pump system (60) having the heat exchanger (100) of the first embodiments.

FIG. 12 illustrates one example of a heat pump system (60) including the heat exchanger (100) according to the first embodiments as a cascade condenser.

The heat pump system (60) includes an outdoor unit (61) including the heat exchanger (100) according to the first embodiments and a plurality of indoor units (62). Furthermore, the heat pump system (60) includes first and second refrigerant circuits (70, 80).

The first refrigerant circuit (70) is provided in the outdoor unit (61) and is configured such that one end and the other end of the first refrigerant circuit (70) are connected with the first liquid inlet/outlet pipe (33) and the first gas inlet/outlet pipe (35) of the heat exchanger (100) according to the first embodiments, respectively. The first refrigerant circuit (70) includes an outdoor air heat exchanger (71). The first refrigerant circuit (70) is such that a first expansion valve (72) is provided between a joint portion with the first liquid inlet/outlet pipe (33) and the outdoor air heat exchanger (71). The first refrigerant circuit (70) is such that a flow channel switching structure is provided between a joint portion with the first gas inlet/outlet pipe (35) and the outdoor air heat exchanger (71), the flow channel switching structure including a first compressor (73) and a first four-way switching valve (74).

The second refrigerant circuit (80) is provided such that the second refrigerant circuit (80) extends out of the outdoor unit (61), branches out to run through the respective indoor units (62), merges after coming out from the indoor units (62), and returns to the outdoor unit (61), and one end and the other end of the second refrigerant circuit (80) are connected with the second liquid inlet/outlet pipe (34) and the second gas inlet/outlet pipe (36) of the heat exchanger (100) according to the first embodiments, respectively. The second refrigerant circuit (80) includes an indoor air heat exchanger (81) inside each indoor unit (62). The second refrigerant circuit (80) is such that, between a joint portion with the second liquid inlet/outlet pipe (34) and the indoor air heat exchangers (81) inside the indoor units (62), a second outdoor expansion valve (82) is provided in the outdoor unit (61) and a second indoor expansion valve (83) is provided in each indoor unit (62). The second refrigerant circuit (80) is such that, inside the outdoor unit (61), a flow channel switching structure is provided between a joint portion with the second gas inlet/outlet pipe (36) and a portion extending toward the indoor air heat exchangers (81) in the indoor units (62), the flow channel switching structure including a second compressor (84) and a second four-way switching valve (85).

—Cooling Operation—

In the heat pump system (60), cooling operation of the indoor units (62) is carried out in such a way that the first four-way switching valve (74) switches over the flow channel so that a first refrigerant (first fluid), which has been boosted in pressure and temperature by the first compressor (73), is sent to the outdoor air heat exchanger (71). The first refrigerant thus sent to the outdoor air heat exchanger (71)

releases heat to condense in the outdoor air heat exchanger (71) through heat exchange with outdoor air. The first refrigerant thus condensed in the outdoor air heat exchanger (71) is sent to the heat exchanger (100) according to the first embodiments after depressurized by the first expansion valve (72). On the other hand, the second four-way switching valve (85) switches over the flow channel so that a second refrigerant (second fluid), which has been boosted in pressure and temperature by the second compressor (84), will be sent to the heat exchanger (100) according to the first embodiments.

In the heat exchanger (100) according to the first embodiments, the first refrigerant flows thereinto via the first liquid inlet/outlet pipe (33) and is distributed uniformly to the plurality of first layers (10) by the first distribution member (40) inside the first liquid transport pore (111), and in each of the first layers (10), the first refrigerant flows through the plurality of first flow channels (12) via the first other end-side collective flow channel (19). Moreover, the second refrigerant flows into the heat exchanger (100) according to the first embodiments via the second gas inlet/outlet pipe (36) and is distributed to the plurality of second layers (20), in each of which the second refrigerant flows through the plurality of second flow channels (22) via the second one end-side collective flow channel (27). When the first and second refrigerants flow in the first and second layers (10, 20) as above, the heat exchange takes place between the first and second layers (10, 20), thereby causing the first refrigerant to absorb heat to evaporate in the first layers (10), while causing the second refrigerant to release the heat to condense in the second layers (20). The first refrigerant thus evaporated in the first layers (10) flows through the first one end-side collective flow channel (17) and flows out via the first gas inlet/outlet pipe (35). The second refrigerant thus condensed in the second layers (20) flows through the second other end-side collective flow channel (29) and flows out via the second liquid inlet/outlet pipe (34).

The first refrigerant thus flowed out via the first gas inlet/outlet pipe (35) is sucked into the first compressor (73) via the first four-way switching valve (74) and boosted in pressure by the first compressor (73) again and sent to the outdoor air heat exchanger (71).

The second refrigerant thus flowed out via the second liquid inlet/outlet pipe (34) flows through the second outdoor expansion valve (82) in the outdoor unit (61) and is sent out from the outdoor unit (61) to the respective indoor units (62). The second refrigerant thus sent to the respective indoor units (62) is depressurized by the second indoor expansion valve (83) and sent to the indoor air heat exchanger (81), in which the second refrigerant absorbs heat to evaporate via heat exchange with indoor air. In this way, the indoor air is cooled down. The second refrigerant thus evaporated in the indoor air heat exchanger (81) is returned to the outdoor unit (61) from the indoor units (62) and sucked into the second compressor (84) via the second four-way switching valve (85), and is boosted in pressure by the second compressor (84) again and sent to the heat exchanger (100) according to the first embodiments.

—Heating Operation—

In the heat pump system (60), heating operation of the indoor units (62) is carried out in such a way that the first four-way switching valve (74) switches over the flow channel so that the first refrigerant, which has been boosted in pressure and temperature by the first compressor (73), is sent to the heat exchanger (100) according to the first embodiments. On the other hand, the second four-way switching valve (85) switches over the flow channel so that the second refrigerant, which has been boosted in pressure and temperature by the second compressor (84), is sent from the outdoor unit (61) to the indoor air heat exchangers (81) of the indoor units (62). The second refrigerant thus sent to the indoor air heat exchanger (81) releases heat to condense in the indoor air heat exchanger (81) through heat exchange with the indoor air. In this way, the indoor air is heated. The second refrigerant thus condensed in the indoor air heat exchanger (81) is depressurized by the second indoor expansion valves (83) in the indoor units (62) and is returned from the indoor units (62) to the outdoor unit (61). The second refrigerant thus returned to the outdoor unit (61) is sent to the heat exchanger (100) according to the first embodiments after depressurized by the second outdoor expansion valve (82) in the outdoor unit (61).

In the heat exchanger (100) according to the first embodiments, the first refrigerant flows thereinto via the first gas inlet/outlet pipe (35) and is distributed to the plurality of first layers (10), in each of which the first refrigerant flows through the plurality of first flow channels (12) via the first one end-side collective flow channel (17). Moreover, the second refrigerant flows into the heat exchanger (100) according to the first embodiments via the second liquid inlet/outlet pipe (34) and is distributed uniformly to the plurality of second layers (20) by the second distribution member (50) in the second liquid transport pore (112), and in each of the second layers (20) the second refrigerant flows through the plurality of second flow channels (22) via the second other end-side collective flow channel (29). When the first and second refrigerants flow in the first and second layers (10, 20) as above, the heat exchange takes place between the first and second layers (10, 20), thereby causing the first refrigerant to release heat to condense in the first layers (10) while causing the second refrigerant to absorb the heat to evaporate in the second layers (20). The first refrigerant thus condensed in the first layers (10) flows through the first other end-side collective flow channel (19) and flows out via the first liquid inlet/outlet pipe (33). The second refrigerant thus evaporated in the second layers (20) flows through the second one end-side collective flow channel (27) and flows out via the second liquid inlet/outlet pipe (34).

The first refrigerant thus flowed out via the first liquid inlet/outlet pipe (33) is sent to the outdoor air heat exchanger (71) after depressurized by the first expansion valve (72), and absorbs heat to evaporate in the outdoor air heat exchanger (71) through heat exchange with the outdoor air. The first refrigerant thus evaporated in the outdoor air heat exchanger (71) is sucked into the first compressor (73) via the first four-way switching valve (74), and boosted in pressure by the first compressor (73) again and sent to the heat exchanger (100) according to the first embodiments.

The second refrigerant thus flowed out via the second gas inlet/outlet pipe (36) is sucked into the second compressor (84) via the second four-way switching valve (85), and boosted in pressure by the second compressor (84) again and sent to the respective indoor units (62).

In the heat pump system (60) configured as above, it is possible to achieve the efficacies of a greater degree of freedom in installation for the heat exchanger (100) according to the first embodiments.

SECOND EMBODIMENTS

Figure 13:
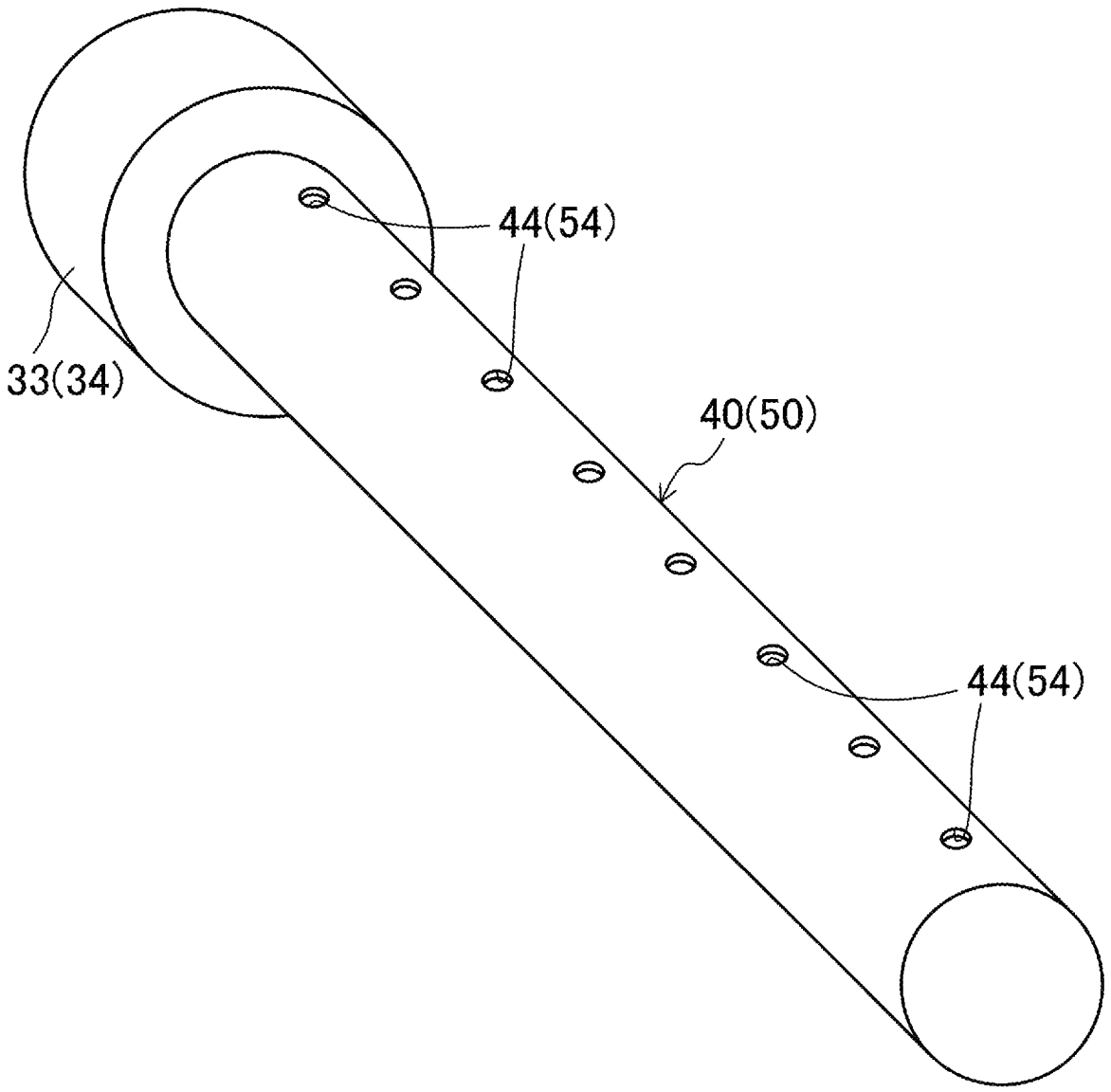
FIG. 13 is a perspective view of a first distribution member (40) (second distribution member (50)) according to second embodiments.
Figure 14:
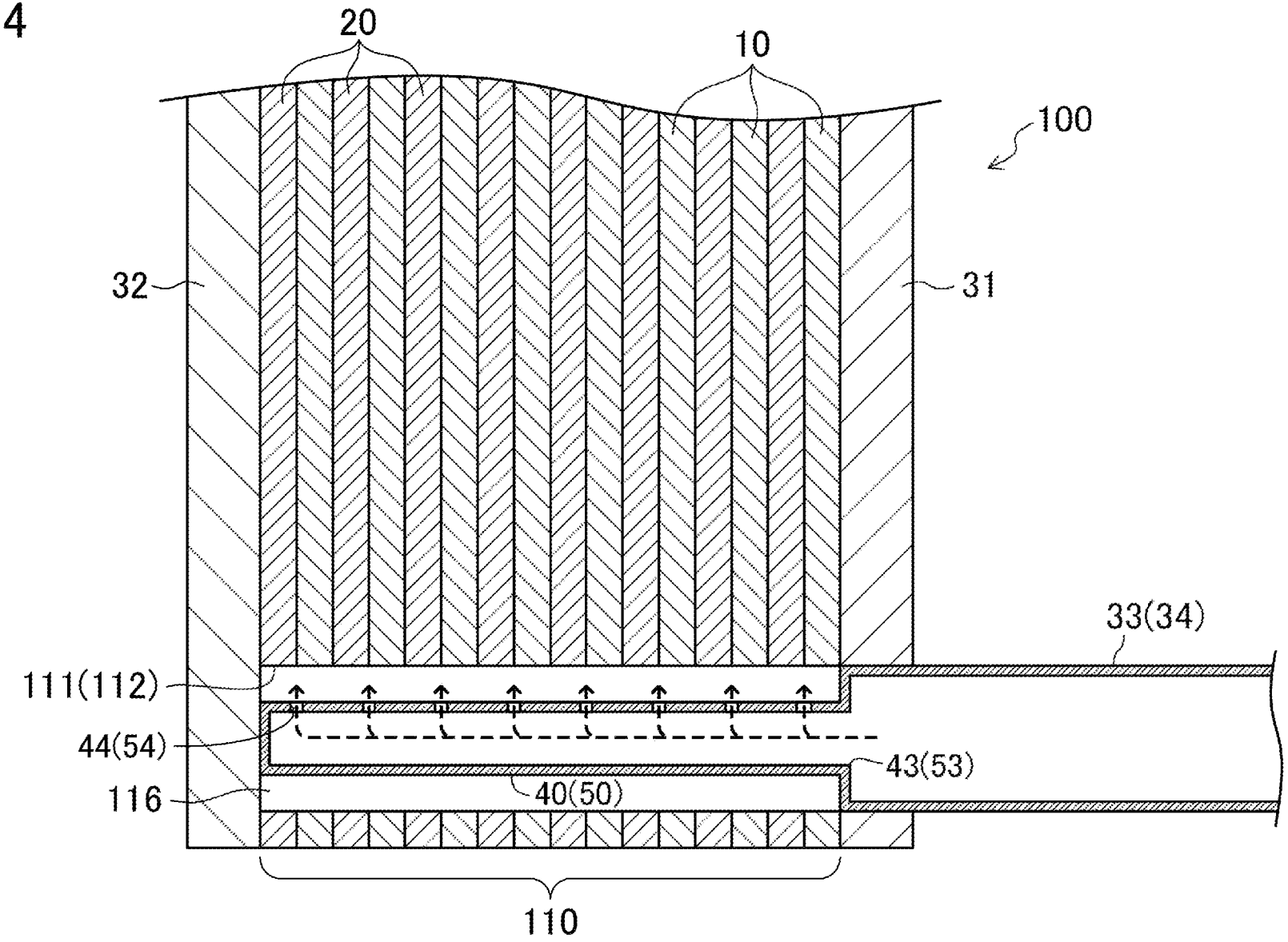
FIG. 14 is a cross-sectional view of a structure of a heat exchanger (100) according to the second embodiments, in which the first distribution member (40) (second distribution member (50)) is provided in a first liquid transport pore (111) (second liquid transport pore (112)).

FIG. 13 illustrates a first distribution member (40) (second distribution member (50)) according to second embodiments. FIG. 14 illustrates a structure of a heat exchanger (100) according to the second embodiments, illustrating how the first distribution member (40) (second distribution member (50)) is provided in the first liquid transport pore (111) (second liquid transport pore (112)). Like references used in the first embodiments are used for like parts herein.

The heat exchanger (100) according to the second embodiments is configured such that the first distribution member (40) is provided at a distal end of the first liquid inlet/outlet pipe (33) coaxially, continuously, and integrally with the distal end, the first distribution member (40) being cylindrical in shape with a diameter smaller than the first liquid inlet/outlet pipe (33). One end of the first distribution member (40) is in fluid communication with the first liquid inlet/outlet pipe (33). In a case of supplying the first fluid containing the liquid as the evaporation source from the first liquid inlet/outlet pipe (33), the first liquid flows into the first distribution member (40) via the one end thereof. The other end of the first distribution member (40) is sealed. Therefore, the first distribution member (40) is constituted as a tubular member whose one end constitutes a fluid inlet section (43) for the first fluid and whose other end is sealed. The first distribution member (40) is provided coaxially to the first liquid transport pore (111) along a longitudinal direction of the first liquid transport pore (111) in such a way that there is a gap (116) fully circumferentially around the first distribution member (40) and the distal end of the first distribution member (40) abuts against the end plate (32), which is the other one of the pair.

The first distribution member (40) has a plurality of openings (44) on an outer peripheral surface of the first distribution member (40), each of the openings (44) being aligned in the longitudinal direction at regular intervals and being in fluid communication with the inside of the first distribution member (40). The plurality of openings (44) is identical with each other in opening area.

Similarly, a second distribution member (50) is provided at a distal end of the second liquid inlet/outlet pipe (34) coaxially, continuously, and integrally with the distal end, the second distribution member (50) being cylindrical in shape with a diameter smaller than the second liquid inlet/outlet pipe (34). One end of the second distribution member (50) is in fluid communication with the second liquid inlet/outlet pipe (34). In a case of supplying the second fluid containing the liquid as the evaporation source from the second liquid inlet/outlet pipe (34), the second liquid flows into the second distribution member (50) via the one end thereof. The other end of the second distribution member (50) is sealed. Therefore, the second distribution member (50) is constituted as a tubular member whose one end constitutes a fluid inlet section (53) for the second fluid and whose other end is sealed. The second distribution member (50) is provided coaxially to the second liquid transport pore (112) along a longitudinal direction of the second liquid transport pore (112) in such a way that there is a gap (116) fully circumferentially around the second distribution member (50) and the distal end of the second distribution member (50) abuts against the end plate (32), which is the other one of the pair.

The second distribution member (50) has a plurality of openings (54) on an outer peripheral surface of the second distribution member (50), each of the openings (54) being aligned in the longitudinal direction at regular intervals and being in fluid communication with the inside of the second distribution member (50). The plurality of openings (54) is identical with each other in opening area.

In the heat exchanger (100) according to the second embodiments configured as above, in a case of evaporating the liquid in the first flow channels (12) in the first layers (10), the first fluid containing the liquid as the evaporation source flows in such a way that, as indicated by the broken line in FIG. 14, the first fluid flows into the first distribution member (40) from the fluid inlet section (43) at the one end of first distribution member (40) and flows out dividedly from the plurality of openings (44) into the gap (116) between the first distribution member (40) and the first liquid transport pore (111). This gap (116) is in fluid communication with the plurality of first flow channels (12) of the plurality of first layers (10). In this configuration, the first fluid flows into the gap (116) dividedly via the plurality of openings (44) after being retained in the first distribution member (40). With the configuration as above, the first fluid within the gap (116) becomes uniform in the longitudinal direction of the gap (116), so that the first fluid can be distributed uniformly to the plurality of first layers (10).

Similarly, in a case of evaporating the liquid in the second flow channels (22) in the second layers (20), the second fluid containing the liquid as the evaporation source flows in such a way that, as indicated by the broken line in FIG. 14, the second fluid flows into the second distribution member (50) from the fluid inlet section (53) at the one end of second distribution member (50) and flows out dividedly from the plurality of openings (54) into the gap (116) between the second distribution member (50) and the second liquid transport pore (112). This gap (116) is in fluid communication with the plurality of second flow channels (22) of the plurality of second layers (20). In this configuration, the second fluid flows into the gap (116) dividedly via the plurality of openings (54) after being retained in the second distribution member (50). With the configuration as above, the second fluid within the gap (116) becomes uniform in the longitudinal direction of the gap (116), so that the second fluid can be distributed uniformly to the plurality of second layers (20).

The second embodiments are the same as or similar to the first embodiments in terms of the other configurations, and can attain the advantages same as or similar to those of the first embodiments.

THIRD EMBODIMENTS

Figure 15:
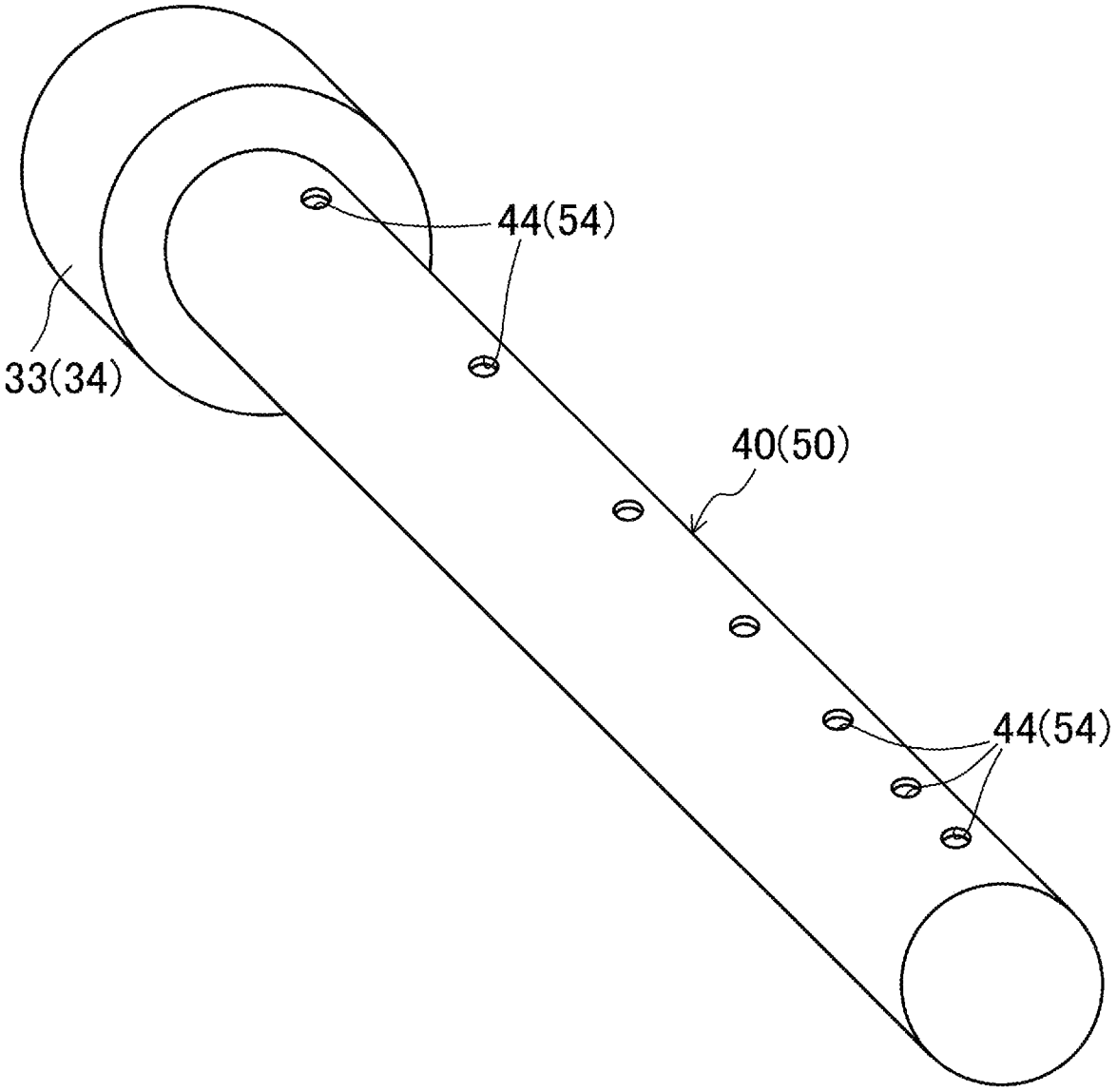
FIG. 15 is a perspective view of a first distribution member (40) (second distribution member (50)) according to third embodiments.
Figure 16:
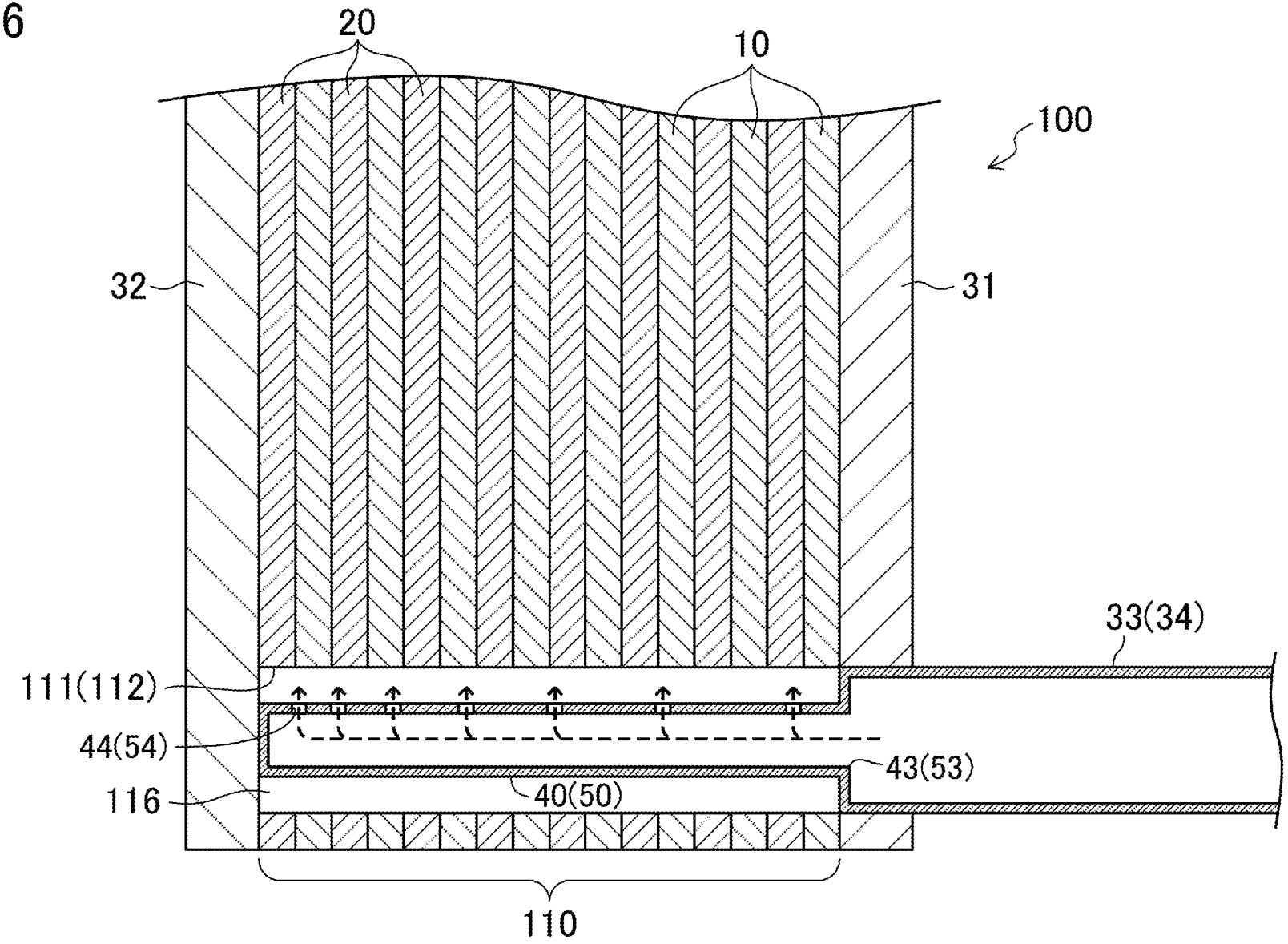
FIG. 16 is a cross-sectional view of a structure of a heat exchanger (100) according to the third embodiments, in which the first distribution member (40) (second distribution member (50)) is provided in a first liquid transport pore (111) (second liquid transport pore (112)).

FIG. 15 illustrates a first distribution member (40) (second distribution member (50)) according to third embodiments. FIG. 16 illustrates a structure of a heat exchanger (100) according to the third embodiments, illustrating how the first distribution member (40) (second distribution member (50)) is provided in the first liquid transport pore (111) (second liquid transport pore (112)). Like references used in the first or second embodiments are used for like parts herein.

In the heat exchanger (100) according to the third embodiments, a plurality of openings (44) formed on the outer peripheral surface of the first distribution member (40) are formed in such a way that spacings of intervals between the openings (44) become smaller toward the other-end side. In other words, the openings (44) more distanced from the fluid inlet section (43) for the first fluid are positioned with smaller spacings therebetween. Similarly, a plurality of openings (54) formed on the outer peripheral surface of the second distribution member (50) are formed in such a way that spacings of intervals between the openings (54) become smaller toward the other-end side. In other words, the openings (54) more distanced from the fluid inlet section (53) for the second fluid are positioned with smaller spacings therebetween. The third embodiments are the same as or similar to the second embodiments in terms of the other configurations.

In the heat exchanger (100) according to the third embodiments configured as above, in a case of evaporating the liquid in the first flow channels (12) in the first layers (10), the first fluid containing the liquid as the evaporation source flows into the gap (116) between the first distribution member (40) and the first liquid transport pore (111) in such a way that amounts of the first fluid flowing into the gap (116) are relatively smaller toward the one-end side more proximal to the fluid inlet section (43) but relatively greater toward the other-end side more distal from the fluid inlet section (43). This configuration facilitates the uniform distribution of the first fluid within the gap (116) along the longitudinal direction thereof by regulating the amounts of the first fluid flowing in from the first distribution member (40).

Similarly, in a case of evaporating the liquid in the second flow channels (22) in the second layers (20), the second fluid containing the liquid as the evaporation source flows into the gap (116) between the second distribution member (50) and the second liquid transport pore (112) in such a way that amounts of the second fluid flowing into the gap (116) are relatively smaller toward the one-end side more proximal to the fluid inlet section (53) but relatively greater toward the other-end side more distal from the fluid inlet section (53). This configuration facilitates the uniform distribution of the second fluid within the gap (116) along the longitudinal direction thereof by regulating the amounts of the second fluid flowing in from the second distribution member (50).

In addition to the advantages as above, the third embodiments can also attain the advantages same as or similar to those of the second embodiments.

FOURTH EMBODIMENTS

Figure 17:
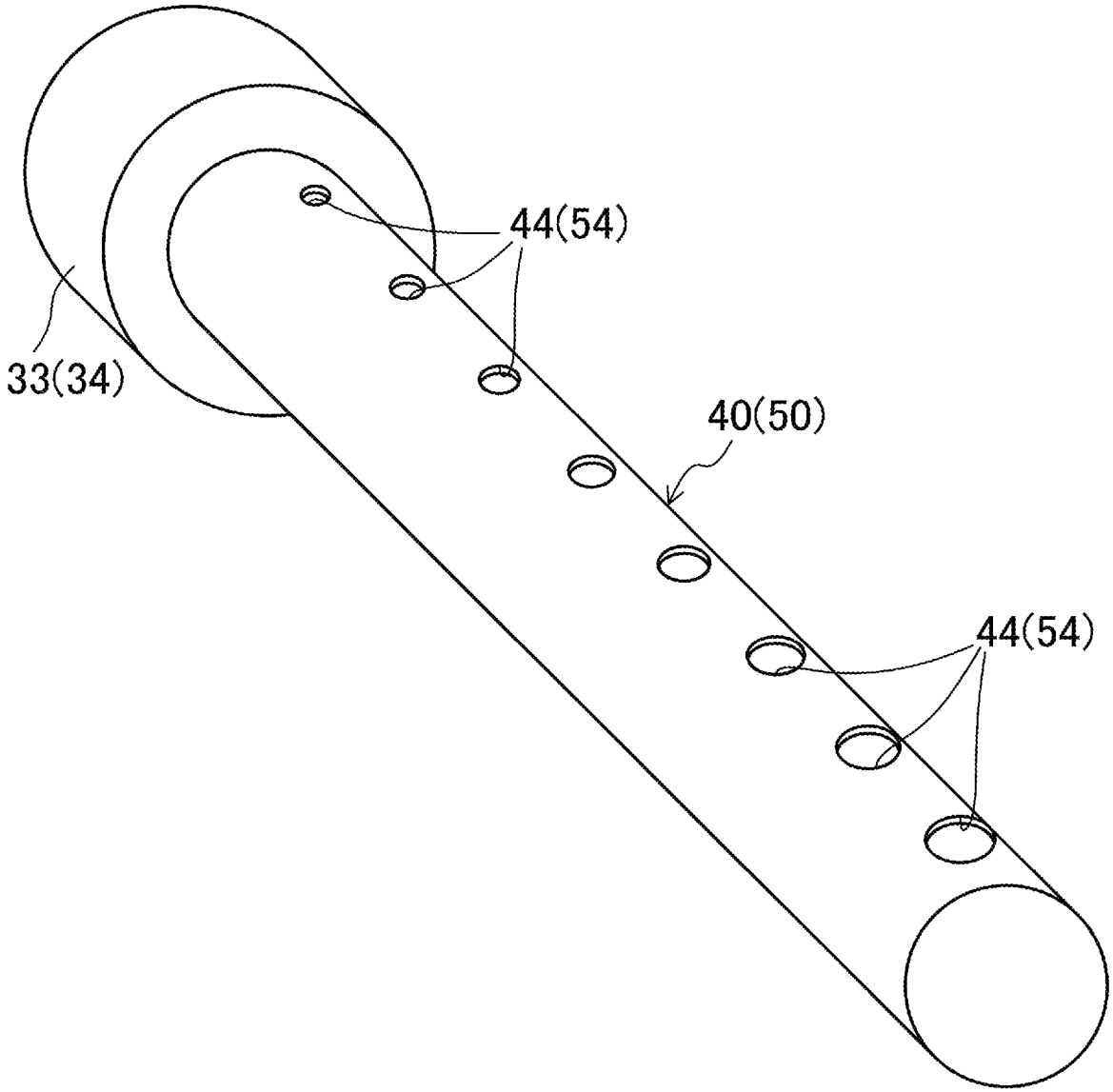
FIG. 17 is a perspective view of a first distribution member (40) (second distribution member (50)) according to fourth embodiments.
Figure 18:
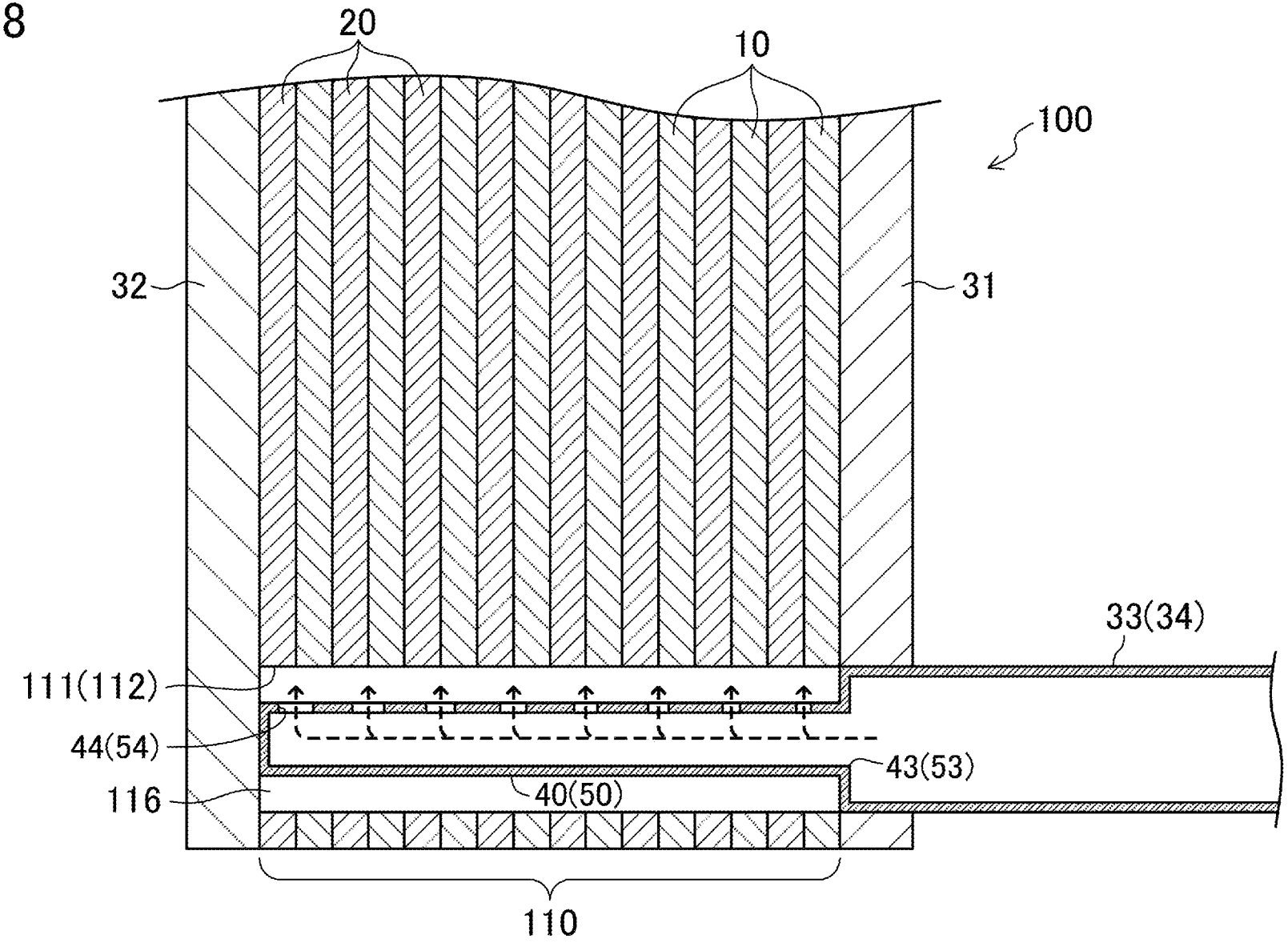
FIG. 18 is a cross-sectional view of a structure of a heat exchanger (100) according to the third embodiments, in which the first distribution member (40) (second distribution member (50)) is provided in a first liquid transport pore (111) (second liquid transport pore (112)).

FIG. 17 illustrates a first distribution member (40) (second distribution member (50)) according to fourth embodiments. FIG. 18 illustrates a structure of a heat exchanger (100) according to the fourth embodiments, illustrating how the first distribution member (40) (second distribution member (50)) is provided in the first liquid transport pore (111) (second liquid transport pore (112)). Like references used in the first or second embodiments are used for like parts herein.

In the heat exchanger (100) according to the fourth embodiments, a plurality of openings (44) formed on the outer peripheral surface of the first distribution member (40) are formed in such a way that opening areas of the openings (44) become greater toward the other-end side. That is, the openings (44) more distanced from the fluid inlet section (43) for the first fluid have a greater opening area. Similarly, a plurality of openings (54) formed on the outer peripheral surface of the second distribution member (50) is formed in such a way that opening areas of the openings (54) become greater toward the other-end side. That is, the openings (54) more distanced from the fluid inlet section (53) for the second fluid have a greater opening area. The fourth embodiments are the same as or similar to the second embodiments in terms of the other configurations.

In the heat exchanger (100) according to the fourth embodiments configured as above, in a case of evaporating the liquid in the first flow channels (12) in the first layers (10), the first fluid containing the liquid as the evaporation source flows into the gap (116) between the first distribution member (40) and the first liquid transport pore (111) in such a way that amounts of the first fluid flowing into the gap (116) are relatively smaller toward the one-end side more proximal to the fluid inlet section (43) but relatively greater toward the other-end side more distal from the fluid inlet section (43). This configuration facilitates the uniform distribution of the fluid within the gap (116) along the longitudinal direction thereof by regulating the amounts of the fluid flowing in from the first distribution member (40).

Similarly, in a case of evaporating the liquid in the second flow channels (22) in the second layers (20), the second fluid containing the liquid as the evaporation source flows into the gap (116) between the second distribution member (50) and the second liquid transport pore (112) in such a way that amounts of the second fluid flowing into the gap (116) are relatively smaller toward the one-end side more proximal to the fluid inlet section (53) but relatively greater toward the other-end side more distal from the fluid inlet section (53). This configuration facilitates the uniform distribution of the fluid within the gap (116) along the longitudinal direction thereof by regulating the amounts of the fluid flowing in from the second distribution member (50).

In addition to the advantages as above, the fourth embodiments can also attain the advantages same as or similar to those of the second embodiments.

OTHER EMBODIMENTS

The present disclosure is not limited to the first to fourth embodiments in which the first and second distribution members (40, 50) are tubular members cylindrical in shape, and may be configured otherwise, provided that the fluid containing the liquid as the evaporation source can be distributed uniformly to the plurality of first layers (10) and/or the plurality of second layers (20).

The present disclosure is applicable to the technical fields of heat exchangers and heat pump systems having the same.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

10, 20 First Layer, Second Layer
12, 22 First Flow Channel, Second Flow Channel
40, 50 First Distribution Member, Second Distribution Member
41, 51 Returning Pore
42, 52 Redirecting Pore
43, 53, 115 Fluid Inlet Section
44, 54 Opening
60 Heat Pump System
100 Heat Exchanger
110 Alternating Lamination
111, 112, First Liquid Transport Pore, Second Liquid Transport Pore
116 Gap

What is claimed is:

1. A heat exchanger, comprising:

first layers each comprising first flow channels that are microchannels; and second layers each comprising second flow channels that are microchannels, wherein the first layers and the second layers constitute a lamination, heat is exchanged by performing either of:

liquid evaporation in the first flow channels and gas condensation in the second flow channels, or liquid evaporation in the second flow channels and gas condensation in the first flow channels, the lamination comprises:

a first liquid transport pore that is in fluid communication with the first flow channels; and a second liquid transport pore that is in fluid communication with the second flow channels, in a case where the liquid evaporation is performed in the first flow channels, the heat exchanger comprises a distribution member in the first liquid transport pore, the distribution member:

uniformly distributes a fluid containing a liquid as an evaporation source to the first layers, has a gap, along a longitudinal direction of the distribution member, between the distribution member and the first liquid transport pore that comprises one end constituting a fluid inlet section for the fluid, and is a tubular member that is sealed at both ends and that comprises:

a returning pore at a proximal position that is proximal to a proximal end of the distribution member to the fluid inlet section along the longitudinal direction; and a redirecting pore at a distal position that is proximal to a distal end of the distribution member from the fluid inlet section along the longitudinal direction, and in a case where the liquid evaporation is performed in the second flow channels, the heat exchanger comprises a distribution member in second liquid transport pore, the distribution member:

uniformly distributes a fluid containing a liquid as an evaporation source to the second layers, has a gap, along a longitudinal direction of the distribution member, between the distribution member and the second liquid transport pore that comprises one end constituting a fluid inlet section for the fluid, and is a tubular member that is sealed at both ends and that comprises:

a returning pore at a proximal position that is proximal to a proximal end of the distribution member to the fluid inlet section along the longitudinal direction; and a redirecting pore at a distal position that is proximal to a distal end of the distribution member from the fluid inlet section along the longitudinal direction.

2. The heat exchanger according to claim 1, wherein an opening area of the returning pore is smaller than an opening area of the redirecting pore.

3. The heat exchanger according to claim 1, wherein the first flow channels and the second flow channels extend in a horizontal direction.

4. The heat exchanger according to claim 1, wherein each of fluids flowing in the first layers and the second layers is a CFC refrigerant or a natural refrigerant, independently.

5. The heat exchanger according to claim 2, wherein the first flow channels and the second flow channels extend in a horizontal direction.

6. The heat exchanger according to claim 2, wherein each of fluids flowing in the first layers and the second layers is a CFC refrigerant or a natural refrigerant, independently.

7. The heat exchanger according to claim 3, wherein each of fluids flowing in the first layers and the second layers is a CFC refrigerant or a natural refrigerant, independently.

8. The heat exchanger according to claim 5, wherein each of fluids flowing in the first layers and the second layers is a CFC refrigerant or a natural refrigerant, independently.

9. A heat pump system comprising the heat exchanger according to claim 1.

10. A heat pump system comprising the heat exchanger according to claim 2.

11. A heat pump system comprising the heat exchanger according to claim 3.

12. A heat pump system comprising the heat exchanger according to claim 4.

13. A heat pump system comprising the heat exchanger according to claim 5.

14. A heat pump system comprising the heat exchanger according to claim 6.

15. A heat pump system comprising the heat exchanger according to claim 7.

16. A heat pump system comprising the heat exchanger according to claim 8.

* * * * *